US006630275B2

(12) United States Patent
Hiratsuka et al.

(10) Patent No.: US 6,630,275 B2
(45) Date of Patent: Oct. 7, 2003

(54) MAGNETIC TONER AND PROCESS CARTRIDGE

(75) Inventors: Kaori Hiratsuka, Shizuoka-ken (JP); Hirohide Tanikawa, Shizuoka-ken (JP); Tsutomu Onuma, Yokohama (JP); Nobuyuki Okubo, Yokohama (JP); Tsuneo Nakanishi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 10/095,991

(22) Filed: Mar. 13, 2002

(65) Prior Publication Data

US 2003/0039908 A1 Feb. 27, 2003

(30) Foreign Application Priority Data

Mar. 15, 2001 (JP) ..... 2001-073483

(51) Int. Cl.[7] ..... G03G 9/083
(52) U.S. Cl. ..... 430/106.1; 430/111.4
(58) Field of Search ..... 430/106.1, 111.4

(56) References Cited

U.S. PATENT DOCUMENTS

| | | | | |
|---|---|---|---|---|
| 5,240,803 | A | 8/1993 | Ota | 430/106 |
| 5,721,433 | A | 2/1998 | Kosaka | 250/573 |
| 5,985,506 | A | 11/1999 | Yuasa et al. | 430/137 |
| 6,033,817 | A | 3/2000 | Yusa et al. | 430/106.6 |
| 6,238,834 | B1 | 5/2001 | Tamura et al. | 430/106.6 |
| 2002/0051922 | A1 | 5/2002 | Yamazaki | 430/106.2 |

FOREIGN PATENT DOCUMENTS

| | | |
|---|---|---|
| EP | 1058157 | 12/2000 |
| JP | 2-87157 | 3/1990 |
| JP | 3-84558 | 4/1991 |
| JP | 3-229268 | 10/1991 |
| JP | 4-1766 | 1/1992 |
| JP | 4-102862 | 4/1992 |
| JP | 6-51561 | 2/1994 |
| JP | 6-342224 | 12/1994 |
| JP | 8-136439 | 5/1996 |
| JP | 10-97095 | 4/1998 |
| JP | 11-194533 | 7/1999 |
| JP | 3094676 | 10/2000 |

*Primary Examiner*—Mark A. Chapman
(74) *Attorney, Agent, or Firm*—Fitzpatrick, Cella, Harper & Scinto

(57) ABSTRACT

A magnetic toner is formed of magnetic toner particles each comprising at least a binder resin and a magnetic iron oxide. The magnetic toner is provided with improved developing performances by realizing an appropriate surface-exposure state of the magnetic iron oxide, which is represented by a wettability characteristic in methanol/water mixture liquids of the magnetic toner such that it shows a transmittance of 80% for light at a wavelength of 780 nm at a methanol concentration in a range of 65–75% and a transmittance of 20% at a methanol concentration in a range of 66–76%.

10 Claims, 13 Drawing Sheets

NEGATIVE GHOST

POSITIVE GHOST

WHITE STREAKS

MAGNETIC TONER AND PROCESS CARTRIDGE

FIELD OF THE INVENTION AND RELATED ART

The present invention relates to a magnetic toner used for developing electrostatic latent images in image forming methods, such as electrophotography and electrostatic recording, or an image forming method of toner jetting scheme, and a process cartridge containing the magnetic toner.

Demands for apparatus utilizing electrophotography have been extended to printers as output means for computers and facsimile apparatus in addition to conventional use as copying machines for reproducing originals. Further, in recent years, increased demands are given to more compact and higher-speed output machines. For complying with such demands, toners have been required to achieve improvements in various items, inclusive of developing performance, low-temperature fixability, prevention of image deterioration in low temperature/low humidity environments, and long-term continuous image forming performances in high temperature/high humidity environments.

More specifically, a toner applicable to a higher-speed printing machine is required to securely retain a uniformly high triboelectric charge on a developing sleeve and be transferred for development onto a photosensitive drum. As a measure for providing an increased toner chargeability, it has been proposed to make the toner shape close to a sphere, and processes for production of such spherical toners by spraying particulation, dissolution in solutions and polymerization have been disclosed in Japanese Laid-Open Patent Application (JP-A) 3-84558, JP-A 3-229268, JP-A 4-1766 and JP-A 4-102862.

On the other hand, in the conventional pulverization toner production process, toner ingredients, such as a binder resin, a colorant and a release agent, are dry-blended and melt-kneaded by conventional kneading apparatus, such as a roll mill, an extruder, etc. After being solidified by cooling, the kneaded product is pulverized and classified by a pneumatic classifier, etc. to adjust a particle size necessary for a toner, and then further blended with external additives, such as a flowability-improving agent and a lubricant, as desired, to formulate a toner used for image formation.

As the pulverization means, various pulverizers have been used, and a jet air stream-type pulverizer, particularly an impingement-type pneumatic pulverizer, is used for pulverization of a coarsely crushed toner product.

In such an impingement-type pneumatic pulverizer, a powdery feed material is ejected together with a high-pressure gas to impinge onto an impingement surface and be pulverized by the impact of the impingement. As a result, the pulverized toner is liable to be indefinitely and angularly shaped, and have a relatively low triboelectric chargeability due to abundant presence of magnetic iron oxide on the toner particle surface, thus being liable to result in a lower image density due to a lower triboelectric charge in a high temperature/high humidity environment.

Spherical toner particles having a smooth and less-angular surface have smaller contact areas with a developing sleeve and the photosensitive drum and exhibit a smaller attachment force onto these members, thus providing a toner showing good developing and transfer efficiencies.

JP-A 2-87157 and JP-A 10-097095 have proposed a method of subjecting toner particles produced through the pulverization process to mechanical impact by a hybridizer to modify the particle shape and surface property, thereby providing an improved transferability. According to this method, more spherical toner particles can be obtained compared with those obtained by the pneumatic pulverization method, thus acquiring a higher triboelectric chargeability. However, as the impact application step is inserted as an additional step after pulverization, the toner productivity and production cost are adversely affected, and further a fine powder fraction is increased due to the surface treatment, so that the toner chargeability is liable to be only locally introduced to result in image defects such as fog in some cases.

JP-A 6-51561 has disclosed a method of sphering toner particles by surface melting in a hot air stream. According to the toner treatment by this method, however, the toner surface composition is liable to be changed to result in an unstable charge increase rate at the time of triboelectrification. As a result, in case where the opportunity of friction is increased as in a high-speed machine, the charge difference is liable to increase between a freshly supplied portion of toner and a remaining portion of toner on the sleeve, thereby causing negative ghost or positive ghost (i.e., a potion of photosensitive drum having provided a solid black image leaves a lower-density portion or a higher-density portion in a subsequent solid halftone image as illustrated in FIGS. 7 and 8, respectively). Further, as a result of high-temperature heat application, a wax component contained in the toner is liable to exude to the toner particle surface, thus adversely affecting anti-blocking property and storability in a high temperature/high humidity environment. Further, Japanese Patent (JP-B) 3094676 has disclosed a toner having a specific dielectric loss obtained through surface modification by treatment in a hot air stream or application of a continuous impact force exerted by a rotating or vibrating stirring impacting member. According to this method, however, magnetic iron oxide exposed to the toner particle surface is positively covered with the resinous toner components, thus failing to function as charge leakage sites for preventing excessive charge to provide an appropriate charge level.

Thus, the toner particle surface state significantly affects the toner chargeability and further the developing performance of the toner. JP-A 6-342224 has disclosed a method of affixing resin fine particles onto base toner particles under application of a mechanical impact force, thereby controlling the resin and wax contents at the toner particle surfaces. According to this method of affixing the resin fine particles under application of a mechanical impact, the resin layer is liable to peel off the toner particle surface, so that it is difficult to uniformly treat the entire toner particles.

JP-A 11-194533 has proposed a method of measuring an absorbance of toner particles dispersed in an ethanol/water mixture solution having a specific volumetric ratio of 26/73 as a measure for evaluating the state of presence of magnetic material on the toner particle surface and controlling the absorbance within a specific range to control the toner chargeability and suppress the toner melt-sticking onto the photosensitive member. According to this method, however, the toner state is checked only at one point, and the entire behavior and distribution of toner particles cannot be evaluated, thus leaving a room for improvement.

EP-A 1058157 has disclosed a magnetic toner comprising toner particles produced by suspension polymerization and having a low surface-exposed iron content. The toner, however, exhibits a low methanol wettability and has left a room for improvement regarding the charging stability in continuous image formation.

SUMMARY OF THE INVENTION

A generic object of the present invention is to provide a magnetic toner having solved the above-mentioned problems.

A more specific object of the present invention is to provide a magnetic toner exhibiting a quick chargeability and capable of suppressing fog and ghost.

Another object of the present invention is to provide a magnetic toner causing little image scattering and exhibiting a high dot reproducibility.

A further object of the present invention is to provide a magnetic toner capable of suppressing image defects such as white streaks caused by developing failure.

According to the present invention, there is provided a magnetic toner, comprising: magnetic toner particles each comprising at least a binder resin and a magnetic iron oxide; wherein the magnetic toner shows a wettability characteristic in methanol/water mixture liquids such that it shows a transmittance of 80% for light at a wavelength of 780 nm at a methanol concentration in a range of 65–75% and a transmittance of 20% at a methanol concentration in a range of 66–76%.

In a preferred embodiment, the magnetic toner has a weight-average particle size X in a range of 4.5–11.0 $\mu$m and contains at least 90% by number of particles having a circularity Ci according to formula (1) below of at least 0.900 with respect to articles of 2 $\mu$m or larger therein, $$Ci=L_0/L \quad (1),$$

wherein L denotes a peripheral length of a projection image of an individual particle, and $L_0$ denotes a peripheral length of a circle having an identical area as the projection image; and the magnetic toner contains a number-basis percentage Y (%) of particles having Ci≧0.950 within particles of 3 $\mu$m or larger satisfying:

$$Y \geqq X^{-0.645} \times exp\ 5.51 \quad (2).$$

The present invention further provides a process cartridge, detachably mountable to a main assembly of an image forming apparatus and comprising: at least an image-bearing member for bearing an electrostatic latent image thereon, and a developing means containing the above-mentioned magnetic toner for developing the electrostatic latent image on the image-bearing member with the magnetic toner to form a toner image.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
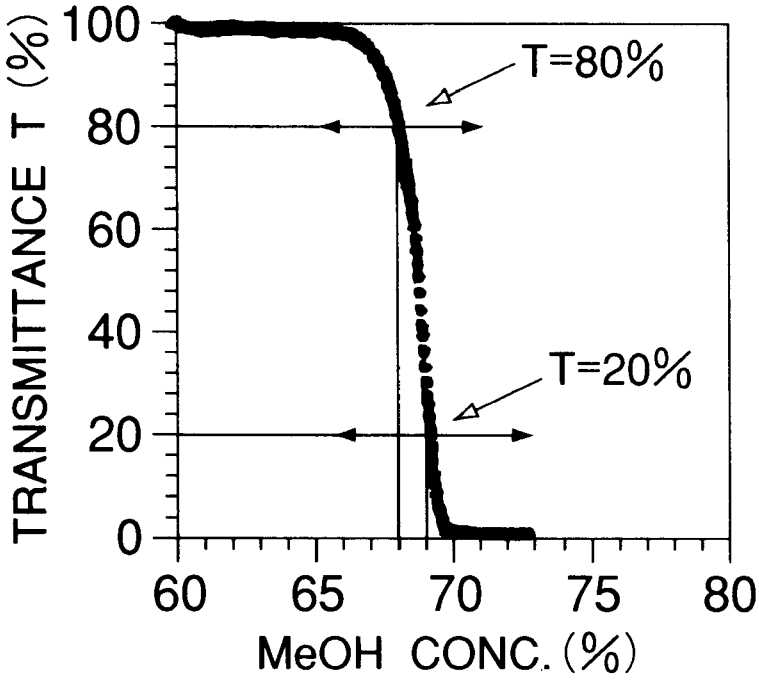
FIG. 1 illustrates a transmittance curve representing a methanol wettability characteristic of a magnetic toner.

As a result of our study on surface states of magnetic toner particles, it has been found possible to provide a magnetic toner exhibiting excellent developing performances by controlling the degree of exposure of magnetic iron oxide at magnetic toner particle surfaces.

We have first noted the surface state of a magnetic toner. As a result, it has been found that a magnetic toner showing specific wettability characteristic (hydrophobicity characteristic) with respect to an aqueous solution of a polar organic solvent represents a proper surface material composition state allowing good image forming characteristics. More specifically, in the present invention, the surface state of a magnetic toner is represented by a change in wettability (degree of sedimentation or suspension) in terms of transmittance through a dispersion of magnetic toner in methanol/water mixture solvents having varying methanol concentrations. Toner ingredients affecting a methanol wettability (hydrophobicity) may include: a resin, a wax, a magnetic iron oxide and a charge control agent. Among these, the amounts of resin and magnetic iron oxide present at the toner particle surface particularly affect the hydrophobicity characteristic of the toner. For example, a magnetic toner containing much magnetic iron oxide at its surface shows a relatively low hydrophobicity (methanol wettability) because of generally hydrophilic nature of the magnetic iron oxide, thus showing a wettability at a low methanol concentration. On the other hand, a magnetic toner rich in resin at its surface shows a hydrophobicity (methanol wettability) because of high hydrophobicity of the resin, thus showing a wettability at a high methanol concentration.

Based on such characteristics, we have found it possible to obtain a magnetic toner showing excellent performances by satisfying specific requirements on a methanol titration transmittance curve.

It is difficult to evaluate the surface state of a magnetic toner only based on local surface observation, so that it is advantageous to evaluate the surface state by monitoring a transition of hydrophobicity based on methanol wettability. The charge retention and discharge of a magnetic toner are governed by a boundary between atmospheric moisture and magnetic toner surface, so that the analysis of hydrophobicity characteristic of a magnetic toner is a most appropriate may of evaluating the charge-discharge characteristics of the toner.

A methanol titration transmittance curve used for evaluating the methanol wettability characteristic of a magnetic toner is obtained according to a method including steps of preparing a sample dispersion liquid by adding a specified amount of magnetic toner to a methanol/water mixture solution, and adding thereto methanol at a prescribed rate of addition to successively measure transmittances through the sample liquid. The magnetic toner of the present invention is a magnetic toner satisfying a specific methanol wettability characteristic (transmittance change characteristic) based on such a methanol titration transmittance curve (hereinafter sometimes simply referred to as a "transmittance curve"). The transmittance curve varies when the surface-exposed state of toner components is changed. Accordingly, the magnetic toner of the present invention can be obtained by selecting an appropriate production process based on knowledge about species and properties of toner ingredients affecting the surface-exposed states thereof.

The magnetic toner of the present invention has a hydrophobicity characteristic as represented by a methanol titration transmittance curve showing a transmittance of 80% in a methanol concentration range of 65–75% and a transmittance of 20% in a methanol concentration range of 66–76%. The proper state of presence of magnetic iron oxide at the toner particle surface is attained where the transmittance curve falls within the ranges, thereby showing a high chargeability (in terms of an absolute value) and retaining a constant chargeability for a long period. As a result, the magnetic toner is less liable to cause image defects, such as ghost or fog, even in a low temperature/low humidity environment or a high temperature/high humidity environment, and shows excellent developing performances.

Methanol titration transmittance curves used for defining the magnetic toner of the present invention were obtained by using a powder wettability tester ("WET-100P", made by Rhesca Co.) in the following manner.

A sample magnetic toner is sieved through a mesh showing an opening of 150 $\mu$m, and the sieved magnetic toner is accurately weighed at 0.1 g. A methanol/water mixture having a methanol concentration of 60% (methanol=60% by volume/water=40% by volume) in a volume of 70 ml is placed as a blank liquid in a 5 cm-dia. and 1.75 mm-thick cylindrical glass flask to measure a transmittance of light having a wavelength of 780 nm (taken as a transmittance of 100%) through the flask containing the blank mixture liquid. Then, a teflon-coated magnetic stirrer (a spindle shape measuring 25 mm in length and 8 mm in maximum width) is placed and rotated at 300 rpm at a bottom of the flask. Under the stirring, the accurately weighed 0.1 g of sample magnetic toner is added to the methanol/water (=60/40 by volume) mixture liquid, and then methanol is continuously added thereto at a rate of 1.3 ml/min through a glass tube of which the tip is inserted into the mixture liquid, whereby the transmittance of the light of 780 nm through the flask containing the sample dispersion liquid is continually measured as relative transmittances with respect to that of the blank mixture liquid as 100%. Thus, a methanol titration transmittance curve as shown in FIG. 1 is obtained. A transmittance T % roughly corresponds to a toner suspension degree of (100-T) %. In the above measurement, methanol is used as a titration solvent because it allows an accurate evaluation of the magnetic toner surface state with little dissolution of additives, such as a dye or pigment and charge control agent, contained in the magnetic toner.

Figure 12:
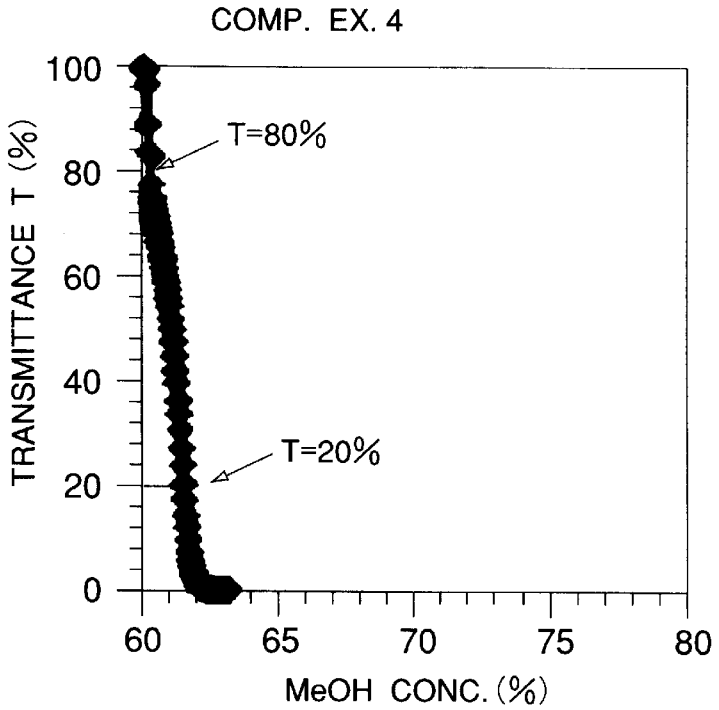

In the above measurement, the initial methanol concentration is set at 60%. Under the measurement condition, in a case where a sample magnetic toner starts to be wetted (i.e., giving a transmittance below 100%) at a methanol concentration below 60%, the transmittance curve descends nearly vertically simultaneously with the start of the measurement. In such a case, if some toner fraction is wetted at a proper methanol concentration of 60% or higher, the transmittance curve shows a corresponding transmittance attenuation characteristic (as shown in FIG. 12 corresponding to a toner of Comparative Example 2 described hereinafter).

In the present invention, the methanol concentration ranges are defined at transmittances of 80% and 20%. A methanol concentration at a transmittance of 80% corresponds to a hydrophobicity of a magnetic toner fraction having a relatively low hydrophobicity, and a methanol concentration at a transmittance of 20% represents a hydrophobicity at which most toner particles are wetted and corresponds to a hydrophobicity of a magnetic toner fraction having a relatively high hydrophobicity. Further, a transmittance descending pattern from a transmittance lowering initiation point (indicating the presence of a wettable toner fraction) represents a hydrophobicity distribution of magnetic toner particles or fractions.

The methanol concentration at a transmittance of 80% in a range of 65–75% represents that even a magnetic toner fraction having a low hydrophobicity allows an appropriate degree of coverage with the resin of magnetic iron oxide and thus surface exposure of an appropriate amount of magnetic iron oxide, thereby providing a high triboelectric chargeability (i.e., a high triboelectric charge in terms of an absolute value). The methanol concentration giving a transmittance of 80% is preferably in a range of 65–72%, more preferably 60–71%, so as to provide a high saturation charge giving images having a sufficient image density. Further, even a magnetic toner fraction having a low hydrophobicity has a certain level or more of hydrophobicity, a once-retained charge can be maintained for a long period.

The methanol concentration giving a transmittance of 20% in a range of 66–76% represents that most toner particles retain a certain amount of magnetic iron oxide at their surface. The methanol concentration at the 20%-transmittance is preferably 66–74%, more preferably 67–72%.

In this way, by measuring a methanol concentration close to a point at which a magnetic toner starts to be wetted with methanol, and a methanol concentration at a point where most toner particles are wetted, it becomes possible to understand a level and a distribution of surface hydrophobicity of magnetic toner particles, and further monitor the magnetic toner quality.

In case where the methanol concentration at a transmittance of 80% is below 65%, it is assumed that a substantial proportion of magnetic toner shows a low hydrophobicity, and a substance showing a high hydrophobicity as represented by magnetic iron oxide is exposed at a high percentage. A magnetic toner having such a surface state is caused to have a low chargeability. Further, even once-charged toner particles are obstructed from retaining the charge due to abundantly present magnetic iron oxide at the surface functioning as leakage sites, thus exhibiting a low developing performance, e.g., in a high temperature/high humidity environment.

On the other hand, in case where the methanol concentration at 80%-transmittance exceeds 75%, magnetic toner having appropriate hydrophobicity is small in amount, and the proportion of magnetic toner particles retaining surface-exposed magnetic iron oxide is reduced. As a result, the magnetic toner is liable to be continually charged to have an excessive charge thus resulting in an inferior dot reproducibility due to scattering, etc.

In case where the methanol concentration at 20%-transmittance is below 60%, a large proportion of magnetic toner particles have a low hydrophobicity because of much magnetic iron oxide exposed to the magnetic toner particle surface, so that it becomes difficult to attain a high chargeability, thus resulting in a low image density after continuation of image formation for a long period.

On the other hand, in case where the methanol concentration at 20%-transmittance exceeds 76%, magnetic toner particles having a high hydrophobicity are present in a large proportion. As a result, the chargeability balance becomes worse to result in a broad triboelectric charge distribution, leading to much ground fog and reversal fog.

In case where the methanol concentration at 80%-transmittance is 65–75% but the methanol concentration at 20%-transmittance is below 66%, only very few toner particles have a relatively high hydrophobicity, so that the entire magnetic toner is caused to have a lower chargeability, thus resulting in a lower image density. On the other hand, in case where the methanol concentration at 80%-transmittance is 65–75% but the methanol concentration at 20%-transmittance exceeds 76%, a large proportion of magnetic toner particles have a hydrophobicity exceeding a certain level, so that the chargeability balance is impaired, thus being liable to result in image defects, such as fog, particularly in a low temperature/low humidity environment.

In case where the methanol concentration at 20%-transmittance is 66–76% but the methanol concentration at 80%-transmittance is below 65%, a large proportion of toner particles have a low hydrophobicity, so that the methanol concentration has a low chargeability as a whole, thus being liable to cause reversal fog due to an insufficient charge. On the other hand, in case where the methanol concentration at 20%-transmittance is 66–76% but the methanol concentration at 80%-transmittance exceeds 75%, the entire magnetic toner is caused to have an excessively high hydrophobicity, thus being liable to have an excessive chargeability and result in inferior dot reproducibility.

A methanol-wettability characteristic or a methanol titration transmittance curve can be obtained also for toner particles similarly as above by using sample toner particles before blending with external additives instead of the above-mentioned sample magnetic toner. It is preferred to toner particles to exhibit a transmittance of 80% in a methanol concentration range of 61–75%.

For producing a magnetic toner (or toner particles) satisfying the above-mentioned wettability characteristic, it is preferred to use a mechanical pulverizer capable of simultaneously effecting pulverization and surface treatment of a powdery feed material to achieve an entirely increased efficiency. More specifically, the amount of magnetic iron oxide at the toner surface can be adequately controlled by adjusting pulverization temperature and surface states of a rotor and a stator of the pulverizer, while details thereof will be described later with reference to FIGS. 3 to 5.

In order to obtain high-definition images while freely enjoin the benefit of the specified methanol wettability characteristic the magnetic toner of the present invention may preferably have a weight-average particle size (D4=X) of 4.5 to 11.0 $\mu$m, more preferably 5.0–10.0 $\mu$m, particularly preferably 5.5–9.0 $\mu$m.

The weight-average particle sizes of magnetic toner particles and magnetic toners described herein are based on values measured according to the Coulter counter method in the following manner.

The particle size distribution of a magnetic toner may be measured according to the Coulter counter method, e.g., by using "Coulter Multisizer II or II-E" (=trade name, available from Coulter Electronics Inc.) connected to an ordinary personal computer via an interface (made by Nikkaki K. K.) for outputting a number-basis and a volume-basis particle size distribution.

In the measurement, a 1%-NaCl aqueous solution may be prepared by using a reagent-grade sodium chloride as an electrolytic solution. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of at least 2 $\mu$m by using the above-mentioned apparatus with a 100 $\mu$m-aperture to obtain a volume-basis distribution and a number-basis distribution. The weight-average particle size ($D_4$) may be obtained from the volume-basis distribution by using a central value as a representative value for each channel. From the number-basis distribution, the content of particles having particle sizes of at most 4.00 $\mu$m (%N ($\leqq$4.00 $\mu$m)) is determined, and from the volume-basis distribution, the amount of particle sizes of at least 10.1 $\mu$m (% V ($\geqq$10.1 $\mu$m)) is also determined.

A magnetic toner is conveyed to a developing sleeve by stirring vanes in a developer chamber and charged by friction of the magnetic toner with a regulating blade and the sleeve while being regulated by the blade on the sleeve. In a high-speed machine, the peripheral speeds of the photosensitive drum and the developing sleeve become much faster than those of lower-speed machines. Accordingly, if the magnetic toner lacks a quick chargeability, the image density increase becomes slower, and a developing failure, such as a negative ghost, is liable to occur in a low temperature/low humidity environment. The magnetic toner according to the present invention satisfying the above-mentioned methanol wettability characteristic shows a quick triboelectric chargeability applicable to a high-speed machine, but if the toner particles thereof have indefinite shapes, the advantageous effect is liable to be diminished. More specifically, such a magnetic toner is caused to have a broad charge distribution, resulting in difficulties in development, such as fog, developing irregularity and inferior dot reproducibility.

As a result of our study, it has been found preferable for a pulverized magnetic toner to have a specific circularity characteristic in addition to the above-mentioned methanol wettability characteristic, so as to have a quick chargeability on a sleeve while suppressing excessive charge.

In the present invention, a circularity (Ci) is used as a convenient parameter for quantitatively indicating a particle shape based on values measured by using a flow-type particle image analyzer ("FPIA-1000", available from Toa Iyou Denshi K. K.). For each measured particle, a circularity Ci is calculated according to equation (1) below.

$$\text{Circularity } Ci = L_0/L \quad (1)$$

wherein L represents a peripheral length of a projection image (two-dimensional image) of an individual particle, and $L_0$ represents a peripheral length of a circle giving an identical area as the projection image.

As is understood from the above equation (1), a circularity Ci is an index showing a degree of unevenness of a particle, and a perfectly spherical particle gives a value of 1.00, and a particle having a more complicated shape gives a smaller value.

For an actual measurement of circularity by using "FPIA-1000, 0.1–0.5 ml of a surfactant (preferably an alkylbenzenesulfonic acid salt) as a dispersion aid is added to 100 to 150 ml of water from which impurities have been removed, and ca. 0.1–0.5 g of sample particles are added thereto. The resultant mixture is subjected to dispersion with ultrasonic waves (50 kHz, 120 W) for 1–3 min. to obtain a dispersion liquid containing 12,000–20,000 particles/$\mu$l (i.e., a sufficiently high particle concentration for ensuring a measurement accuracy), and the dispersion liquid is subjected to measurement of a circularity distribution with respect to particles having a circle-equivalent diameter ($D_{CE}=L_0/\pi$) in the range of 3 $\mu$m to below 159.21 $\mu$m by means of the above-mentioned flow-type particle image analyzer.

The details of the measurement is described in a technical brochure and an attached operation manual on "FPIA-1000" published from Toa Iyou Denshi K. K. (Jun. 25, 1995) and JP-A 8-136439 (U.S. Pat. No. 5721433). The outline of the measurement is as follows.

A sample dispersion liquid is caused to flow through a flat thin transparent flow cell (thickness=ca. 200 $\mu$m) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two-dimensional image having a certain area parallel to the flow cell. From the two-dimensional image area of each particle, a diameter of a circle having an identical area (an equivalent circle) is determined as a circle-equivalent diameter ($D_{CE}=L_0/\pi$). Further, for each particle, a peripheral length ($L_0$) of the equivalent circle is determined and divided by a peripheral length (L) measured on the two-dimensional image of the particle to determine a circularity Ci of the particle according to the above-mentioned formula (1).

Based on the above-mentioned circularity (Ci) measurement data, it is preferred for the magnetic toner according to the present invention to have a weight-average particle size X (=D4) in a range of 4.5–11.0 $\mu$m, contain at least 90% by number of particles having Ci≧0.900, and contain a number-basis percentage Y (%) of particles having Ci≧0.950 within particles of 3 $\mu$m or larger satisfying:

$$T \geqq exp\ 5.51 \times X^{-0.645} \quad (2).$$

By satisfying the above-mentioned circularity characteristic, the magnetic toner according to the present invention can acquire an increased opportunity of contact with a triboelectrically charging member, such as a developing sleeve to have a quick chargeability and exhibit good developing performances from an initial stage of continuous image formation without causing ghosts. Further, the magnetic toner can exhibit good developing performances over a long period of continuous image formation.

In case where the magnetic toner contains less than 90% by number of particles having Ci≧0.900, the magnetic toner is caused to have somewhat inferior quick chargeability, thus being liable to cause a ghost, particularly in a low temperature environment.

Further, in case where the magnetic toner fails to satisfy the relationship of the formula (2) regarding the number-basis percentage Y (%) of particles having Ci≧0.950, the magnetic toner is liable to have a lower transferability and also a lower flowability. As a result, the magnetic toner is liable to have inferior developing performances, inclusive of inferior quick chargeability, particularly in a high temperature/high humidity environment.

By satisfying the above-mentioned methanol wettability characteristic and circularity characteristic, the magnetic toner according to the present invention can exhibit a quick chargeability and retain a good chargeability over a long period, thus exhibiting excellent image forming characteristics in various environments inclusive of a high temperature/high humidity environment and a low temperature/low humidity environment.

A magnetic toner having a high circularity can minimize the contact area between toner particles and suppress the agglomeratability of toner particles. Further, compared with angular toner particles, the spherical toner particles showing a high circularity can acquire more triboelectrifiable points, thus being able to quickly acquire a high charge. Moreover, by controlling only the circularity, it is difficult to retain the acquired charge depending on the magnetic toner particle surface state, thus lowering the developing performance on continuation of image formation. In the present invention, by providing a magnetic toner satisfying the specific methanol wettability characteristic, the magnetic toner is allowed to acquire a high charge and retain the high charge for a long period. As a result, the magnetic toner can exhibit good developing performances over a long period without causing developing failure, such as fog and ghost.

Figure 9:
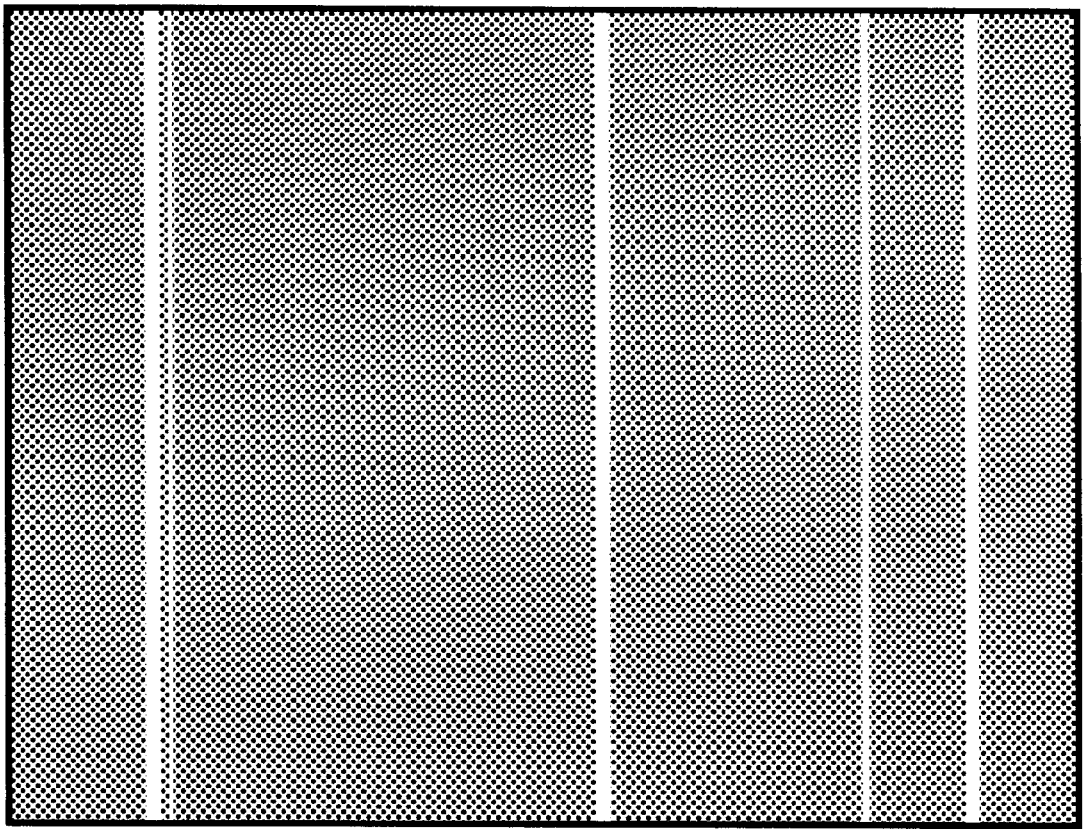
FIG. 9 illustrates an image defect of white streaks.

A conventional magnetic toner is liable to suffer from difficulties in a low temperature/low humidity environment because of inferior quick chargeability and instability of acquired charge such that halftone images obtained at the initial stage of printing in a low temperature/low humidity environment are accompanied with white streaks (as shown in FIG. 9). By satisfying the methanol wettability characteristic, the magnetic toner of the present invention can stably exhibit a quick chargeability even in a low temperature/low humidity environment, halftone images formed at the initial stages of printing can be free from the occurrence of white streaks.

Now, some description will be made on a mechanical pulverizer which is preferably used a a pulverizing means for producing the magnetic toner according to the present invention, such a mechanical pulverizer may be provide by a commercially available pulverizer, such as "KTM" or "KRYPTRON" (both available from Kawasaki Jukogyo K. K.) or "TURBOMILL" (available from Turbo Kogyo K. K.), as it is, or after appropriate re-modeling.

Figure 3:
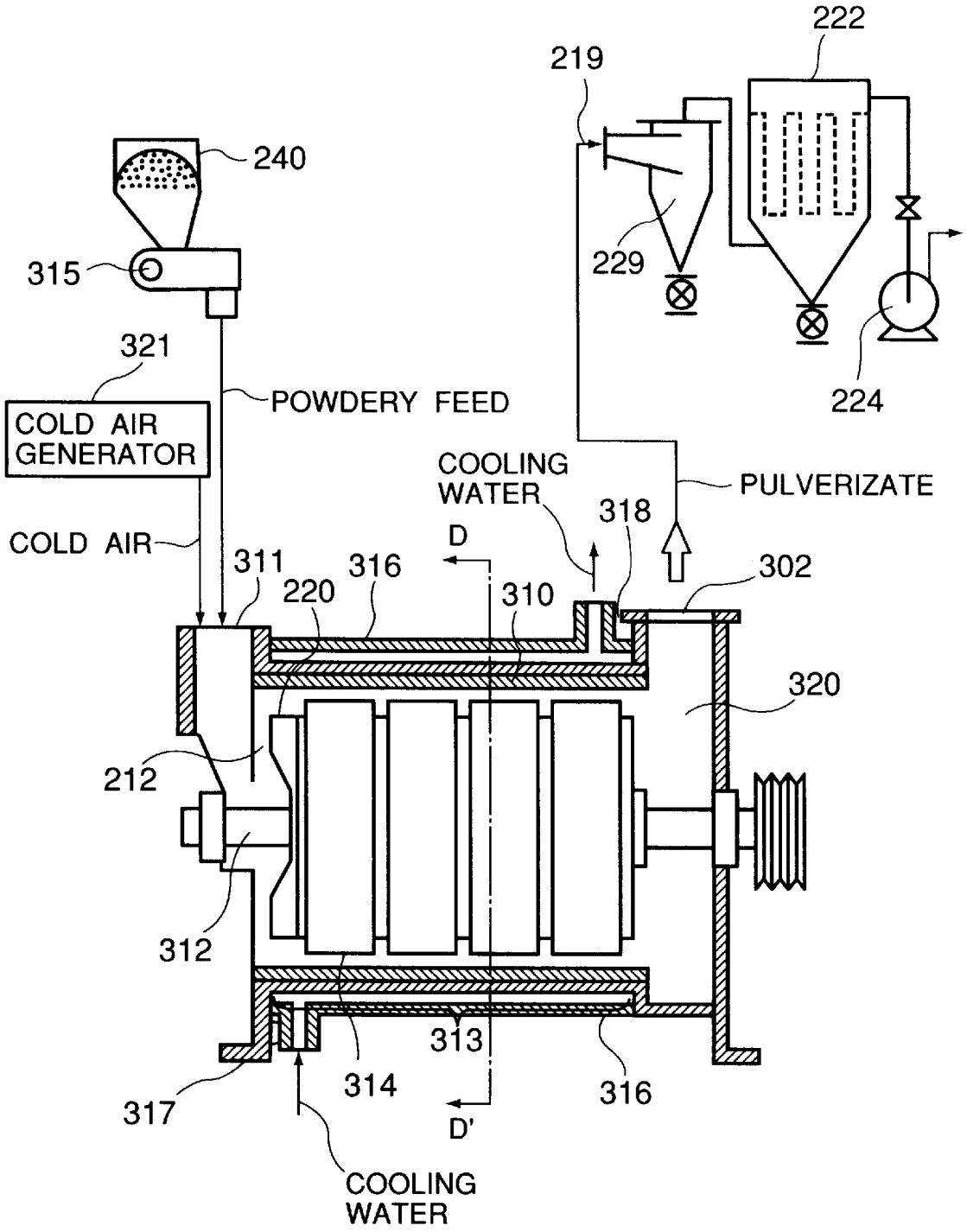
FIG. 3 is a schematic sectional view of a mechanical pulverizer used in a toner pulverization step.
Figure 4:
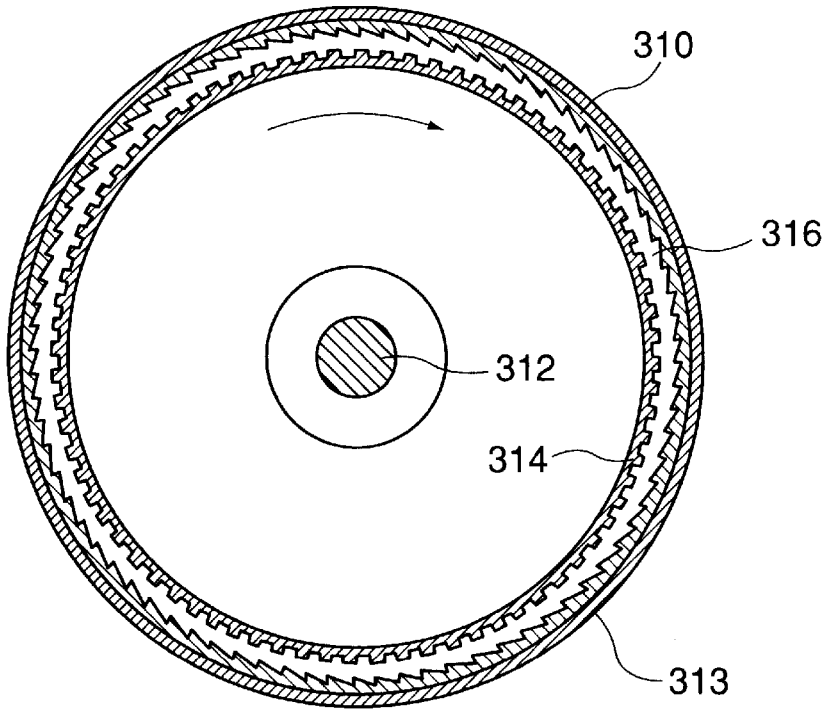
FIG. 4 is a schematic sectional view of a D–D' section in FIG. 3.
Figure 5:
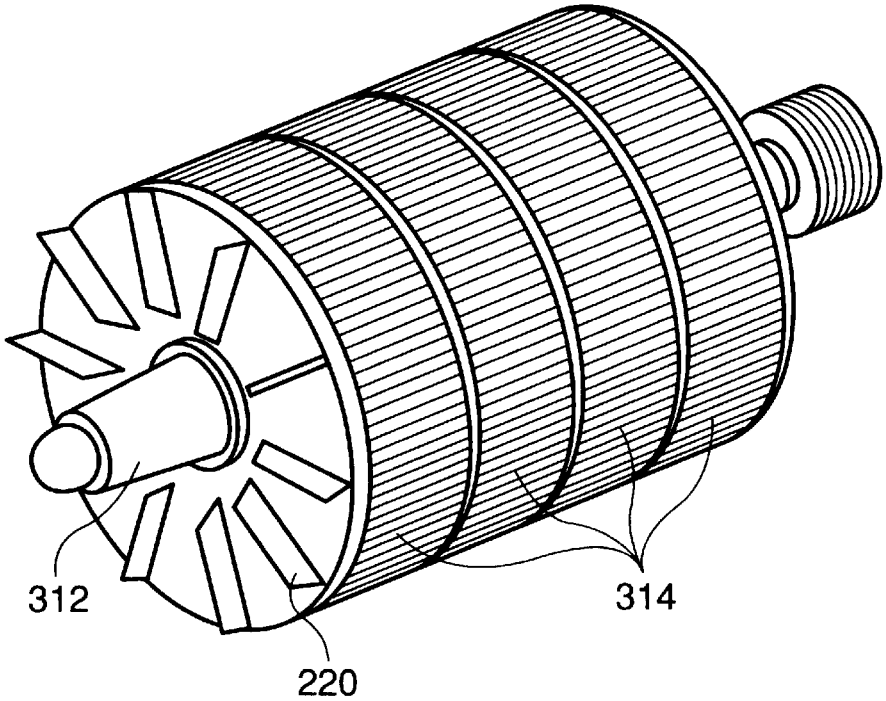
FIG. 5 is a perspective view of a rotor contained in the pulverizer of FIG. 3.

It is particularly preferred to adopt a mechanical pulverizer as illustrated in FIGS. 3–5, for pulverizing a powdery feed (a coarsely crushed melt-kneaded product of magnetic toner ingredients).

Now, the organization of a mechanical pulverizer will be described with reference to FIGS. 3–5. FIG. 3 schematically illustrates a sectional view of a mechanical pulverizer; FIG. 4 is a schematic sectional view of a D—D section in FIG. 3, and FIG. 5 is a perspective view of a rotor 314 in FIG. 3. As shown in FIG. 3, the pulverizer includes a casing 313; a jacket 316; a distributor 220; a rotor 314 comprising a rotating member affixed to a control rotation shaft 312 and disposed within the casing 313, the rotor 314 being provided with a large number of surface grooves (as shown in FIG. 5) and designed to rotate at a high speed; a stator 310 disposed with prescribed spacing from the circumference of the rotor 314 so as to surround the rotor 314 and provided with a large number of surface grooves; a feed port 311 for introducing the powdery feed; and a discharge port 302 for discharging the pulverized material.

In a pulverizing operation, a powdery feed is introduced at a prescribed rate from a hopper 240 and a first metering feeder 315 through a feed port 311 into a processing chamber, where the powdery feed is pulverized in a moment under the action of an impact caused between the rotor 314 rotating at a high speed and the stator 310, respectively provided with a large number of surface grooves, a large number of ultra-high speed eddy flow occurring thereafter and a high-frequency pressure vibration caused thereby. The pulverized product is discharged out of the discharge port 302. Air conveying the powdery feed flows through the processing chamber, the discharge port 302, a pipe 219, a collecting cyclone 209, a bag filter 222 and a suction blower 224 to be discharged out of the system.

The conveying air is preferably cold air generated by a cold air generation means 321 and introduced together with the powdery feed, and the pulverizer main body is covered with a jacket 316 for flowing cooling water or liquid (preferably, non-freezing liquid comprising ethylene glycol, etc.), so as to maintain a temperature T1 within a whirlpool chamber 212 communicating with the feed port 311 at 0° C. or below, more preferably −5 to −2° C., in view of the toner productivity. This is effective for suppressing the occurrence of excessive temperature increase due to pulverization heat, thereby allowing effective pulverization of the powdery feed.

The cooling liquid is introduced into the jacket 316 via a supply port 317 and discharged out of a discharge port 318.

In the pulverization operation, it is preferred to set the temperature T1 in the whirlpool chamber 212 (gaseous phase inlet temperature) and the temperature T2 in a rear chamber 320 (gaseous phase outlet temperature) so as to provide a temperature difference ΔT (=T2−T1) of 30–80° C., more preferably 35–75° C., further preferably 37–72° C., thereby suppressing wax exudation to the magnetic toner particle surface, providing a surface state of magnetic iron oxide being moderately covered with the resin, and effectively pulverizing the powdery feed. A temperature difference ΔT of below 30° C. suggests a possibility of short pass of the powdery feed without effective pulverization thereof, thus being undesirable in view of the toner performances. On the other hand, ΔT>80° C. suggests a possibility of the over-pulverization, and melt-sticking of toner particles onto the apparatus wall and thus adversely affecting the toner productivity.

The pulverization of the powdery feed by a mechanical pulverizer has been conventionally practiced so as to control the temperature T1 of the whirlpool chamber 2/2 and the temperature T2 of the rear chamber 320, thereby effecting the pulverization at a temperature below the Tg (glass transition temperature) of the resin. However, in order to provide a magnetic toner satisfying the above-mentioned properties, it is preferred to set the temperature T2 of the rear chamber to a temperature of Tg−10° C. to +5° C., more preferably Tg−5° C. to 0° C., so as to provide an actual pulverization of temperature (i.e., particle surface temperature in the pulverization region) Tg−5° C. to +10° C. By satisfying the temperature range, a portion of the magnetic iron oxide at the magnetic toner particle surface is covered with a thin film of the resin to provide an appropriate degree of exposure of the magnetic iron oxide, thus providing a magnetic toner satisfying the above-mentioned methanol wettability characteristic and showing desired chargeability of exhibiting a high triboelectric chargeability while obviating excessive charge. Further, by controlling the temperature T2 within the above-mentioned temperature range, it becomes possible to effectively pulverize the coarsely crushed powdery feed.

In case when T2 is below Tg−10° C., the powdery feed is pulverized only by a mechanical impact force, the magnetic iron oxide is exposed to the toner particle surface at a high exposure rate to result in a lower methanol wettability (lower hydrophobicity), leading to low developing performance as described above.

On the other hand, in case where T2 is above Tg +5° C., the toner particle surface is supplied with excessive heat to provide a thick resin coating over the magnetic iron oxide, thus resulting in a higher methanol wettability (a higher hydrophobicity) leading to developing failure, such as fog and ghost.

In pulverizing the crushed powdery feed by a mechanical pulverizer, it is preferred to warm the temperature of the powdery feed to a temperature which is in a range of −20° C. to +5° C., more preferably −20° C. to 0° C., of the resin Tg. By setting the feed temperature in the temperature range, the crushed powdery feed can be easily susceptible of thermal deformation, so that hydrophobic toner components, such as resin and wax, can readily exude to the toner particle surface, thus providing an appropriate surface coverage state of the magnetic toner of the present invention.

The rotor 314 may preferably be rotated so as to provide a circumferential speed of 80–180 m/s, more preferably 90–170 m/s, further preferably 100–160 m/s. As a result, it becomes possible to suppress insufficient pulverization or overpulverization, suppress the isolation of magnetic iron oxide particles due to the overpulverization and allow effective pulverization of the powdery feed. A circumferential speed below 80 m/s of the rotor 314 is liable to cause a short pass without pulverization of the feed, thus resulting in inferior toner performances. A circumferential speed exceeding 180 m/s of the rotor invites an overload of the apparatus and is liable to cause overpulverization resulting in surface deterioration of toner particles due to heat, and also melt-sticking of the toner particles onto the apparatus wall.

Such a rotor and a stator of a mechanical pulverizer are frequently composed of a carbon steel such as S45C or chromium-molybdenum-steel such as SCM, but these steel materials do not have a sufficient wear resistance, thus requiring frequent exchange of the rotor and the stator. Accordingly, the stator and rotor surfaces may preferably have been subjected to an anti-wear resistance treatment, such as a wear-resistant plating or coating with a self-fluxing alloy. This is also effective for providing a uniformly provide toner particle surface giving an appropriate methanol wettability.

By applying an anti-water treatment with a wear-resistant plating or a self-fluxing alloy, it is possible to provide a rotor and a stator showing a high surface hardness and a high wear-resistance, thus showing a long life. The thus formed uniformly smooth surface gives a lower friction coefficient leading to a longer life and allows the provision of uniform toner properties. The rotor or stator subjected to the anti-wear treatment may be further subjected to a surface roughness-adjusting treatment as by polishing such as buffing or blasting such as sand blasting.

The rotor and stator may preferably have a surface hardness (Vickers hardness) of 400–1300, more preferably 500–1250, particularly preferably 900–1230, as measured under a load of 0.4903N for a period of 30 sec.

The use of such a rotor and/or a stator subjected to anti-wear treatment as by a wear-resistant plating or a self-fluxing alloy not only reduces the wearing of the pulverization surface of these members to provide a longer life, but also allows a lower peripheral speed of the rotor for achieving a desired pulverization effect due to the higher surface hardness, thus lowering the pulverization load or increasing the pulverization capacity. This also allows a further stabilization of product toner qualities.

Further, the rotor 314 and the stator 310 may preferably be disposed to provide a minimum gap therebetween of 0.5–10.0 mm, more preferably 1.0–5.0 mm, further preferably 1.0–3.0 mm. As a result, it becomes possible to suppress insufficient pulverization or overpulverization, and allow effective pulverization of the powdery feed. A gap exceeding 10.0 mm between the rotor 314 and the stator 310 is liable to cause a short pass without pulverization of the powdery feed, thus adversely affecting the toner performance. A gap smaller than 0.5 mm invites an overload of the apparatus and is liable to cause overpulverization. Further, the overpulverization is also liable to result in surface deterioration of toner particles due to heat, and melt-sticking of the toner particles onto the apparatus wall.

In the pulverization process including the use of a mechanical pulverizer, toner ingredients including at least the binder resin and the magnetic iron oxide are melt-kneaded, cooled and the coarsely crushed, and the thus-formed coarsely crushed product is supplied as a powdery feed to the mechanical pulverizer. As mentioned above, it is preferred to warm the coarsely crushed powdery feed to a temperature in a range of −25° C. to +5° C. of the Tg (glass-transition temperature) of the binder resin before the powdery feed is supplied to the mechanical pulverizer. In the pulverization process using a mechanical pulverizer, a first classification step for classifying the coarsely crushed product is not required, so that the liability of agglomerates of fine powder fraction from the mechanical pulverizer to be supplied to a second classification step being actually recycled to the first classification step to cause overpulverization can be obviated, thus preventing occurrence of ultrafine powder and providing an improved classification yield. Further, in addition to the simple organization, a large amount of air is not required for pulverizing the powdery feed unlike a pneumatic pulverizer, so that the power consumption is suppressed and the production energy cost is suppressed.

The magnetic toner particles of the present invention may preferably have a BET specific surface area ($S_{BET}$) of 0.7–1.3 $m^2/g$, more preferably 0.8–1.25 $m^2/g$, further preferably 0.85–1.20 $m^2/g$. In view of the pulverization condition in combination, magnetic toner particles having a BET specific surface area in the above-mentioned range are allowed to have a sufficient charge per unit area, thus providing a stable image density over a long period. If $S_{BET}$ is below 0.7 $m^2/g$, the magnetic toner is liable to have a high charge in terms of absolute value, because of a large charge density per unit area, thus being liable to result in an undesirable phenomenon, such as fog or ghost. On the other hand, if $S_{BET}$ is above 1.3 $m^2/g$, the magnetic toner is liable to have an insufficient charge, because of a small charge density per unit area, thus being liable to result in an undesirable phenomenon, such as a low image density.

The values of specific surface area ($S_{BET}$) described herein are based on values measured by a specific surface area meter ("GEMINI 2375", made by Shimadzu-Seisakusho) according to the BET multi-point method using nitrogen as the adsorbate gas.

The binder resin for the magnetic toner of the present invention may preferably have a glass transition temperature (Tg) of 45–80° C., more preferably 50–70° C., from the viewpoint of storage stability. If Tg is below 45° C., the magnetic toner is liable to be deteriorated in a high temperature environment and also cause fixation offset. If Tg is above 80° C., the magnetic toner is liable to show an inferior fixability.

The glass transition temperature (Tg) values described herein are based on values measured by using a differential scanning calorimeter ("DSC-7", made by Perkin-Elmer Corp.) in the following manner.

A sample in an amount of 0.5–2 mg, preferably 1 mg, is placed on an aluminum pan and subjected together with a blank aluminum pan as a reference to a heating-cooling cycle including a first heating in a range of 20 to 180° C. at a rage of 10° C./min, a cooling in a range of 180–20° C. at a rate of 10° C./min and a second heating in a range of 10 to 180° C. at a rate of 10° C./min. Based on the second heating DSC curve, a mid line is drawn between base lines before and after a heat-absorption peak, and a temperature at the intersection of the mid line with the second heating DSC curve is taken as the Tg of the binder resin.

For the production of the magnetic toner according to the present invention, a wax component may be mixed and dispersed in the binder resin in advance. It is particularly preferred to prepare a binder composition by preliminarily dissolving a wax component and a high-molecular weight polymer in a solvent, and blending the resultant solution with a solution of a low-molecular polymer. By preliminarily mixing the wax component and the high-molecular polymer in this way, it becomes possible to alleviate microscopic phase separation and provide a good state of dispersion with the low-molecular weight polymer without causing re-agglomeration of the high-molecular weight component.

The molecular weight distribution of a toner or a binder resin may be measured according to GPC (gel permeation chromatography) using THF (tetrahydrofuran) as the solvent in the following manner.

In the GPC apparatus, a column is stabilized in a heat chamber at 40° C., tetrahydrofuran (THF) solvent is caused to flow through the column at that temperature at a rate of 1 ml/min., and ca. 100 $\mu$l of a sample solution in THF is injected. The identification of sample molecular weight and its distribution is performed based on a calibration curve obtained by using several monodisperse polystyrene samples and having a logarithmic scale of molecular weight versus count number. The standard polystyrene samples may be available from, e.g., Toso K. K. or Showa Denko. It is appropriate to use at least 10 standard polystyrene samples having molecular weights ranging from a. $10^2$ to ca. $10^7$. The detector may be an RI (refractive index) detector. It is appropriate to constitute the column as a combination of several commercially available polystyrene gel columns. For example, it is possible to use a combination of Shodex GPC KF-801, 802, 803, 804, 805, 806, 807 and 808P available from Showa Denko K. K.; or a combination of TSKgel G1000H ($H_{XL}$), G2000H ($H_{XL}$), G3000H ($H_{XL}$), G4000H ($H_{XL}$), G5000H ($H_{XL}$), G7000H ($H_{XL}$) and TSK-guard column available from Toso K. K.

A GPC sample solution is prepared in the following manner.

A sample is added to THF and left standing for several hours. Then, the mixture is well shaked until the sample mass disappears and further left to stand still for at least 24 hours. Then, the mixture is caused to pass through a sample treatment filter having a pore size of 0.45–0.5 $\mu$m (e.g., "MAISHORI DISK H-25-2", available from Toso K. K.; or "EKIKURO DISK", available from German Science Japan K. K.) to obtain a GPC sample having a resin concentration of 0.5–5 mg/ml.

Examples of the binder resin species for constituting the magnetic toner of the present invention may include: styrene resin, styrene copolymer resin, polyester resin, polyol resin, polyvinyl chloride resin, phenolic resin, natural resin-modified phenolic resin, natural resin-modified maleic acid resin, acrylic resin, methacrylic resin, polyvinyl acetate, silicone resin, polyurethane resin, polyamide resin, furan resin, epoxy resin, xylene resin, polyvinyl butyral, terpene resin, coumarone-indene resin, and petroleum resin.

Examples of co-monomers for providing styrene copolymers together with styrene monomer may include: styrene derivatives, such as vinyltoluene; acrylic acid; acrylates, such as methyl acrylate, ethyl acrylate, butyl acrylate, dodecyl acrylate, octyl acrylate, 2-ethylhexyl acrylate, and phenyl acrylate; methacrylic acid; methacrylates, such as methyl methacrylate, ethyl methacrylate, butyl methacrylate, dodecyl methacrylate, octyl methacrylate, 2-ethylhexyl methacrylate and phenyl methacrylate; unsaturated dicarboxylic acids and mono- or di-esters thereof, such as maleic acid, maleic anhydride monobutyl maleate, methyl maleate and dimethyl maleate; acrylamide, methacrylamide, acrylonitrile, methacrylonitrile; butadiene; vinyl chloride, vinyl acetate, vinyl benzoate; ethylene olefins, such as ethylene, propylene and butylene; vinyl ketones, such as vinyl methyl ketone and vinyl hexyl ketone; and vinyl ethers, such as vinyl methyl ether, vinyl ethyl ether and vinyl isobutyl ether. These vinyl monomers may be used singly or in mixture of two or more species.

The binder resin used in the present invention may preferably have an acid value of 1–100 mgKOH/g, more preferably 1–70 mgKOH/g.

Preferred examples of monomers used for adjusting an acid value of the binder resin may include: acrylic acid and α- and β-alkyl derivatives thereof, such as acrylic acid, methacrylic acid, α-ethylacrylic acid, crotonic acid, cinnamic acid, vinylacetic acid, isocrotonic acid and angelic acid; and unsaturated dicarboxylic acids, such as fumaric acid, maleic acid, citraconic acid, alkenylsuccinic acid, itaconic acid, mesconic acid, dimethylmaleic acid and dimethylfumaric acid, and monoester derivatives or anhyrides thereof. These monomers may be used singly or in mixture of two or more species together with another monomer to provide a desired copolymer. Among the above, a monoester derivative of an unsaturated dicarboxylic acid may preferably be used to control the acid value.

Specific examples thereof may include: mono-esters of α,β-unsaturated dicarboxylic acids, such as monomethyl maleate, monoethyl maleate, monobutyl maleate, monooctyl maleate, monoallyl maleate, monophenyl maleate, monomethyl fumarate, monobutyl fumarate and monophenyl fumarate; and mono-esters of alkenyldicarboxylic acids, such as monobutyl n-butenylsuccinate, monomethyl n-octenylsuccinate, monoethyl n-butenylmalonate, monomethyl n-dodecenyl glutarate, and monobutyl n-butenyladipate.

The above-mentioned acid value-adjusting monomer (carboxyl group-containing monomer) may be contained in a proportion of 0.1–20 wt. parts, preferably 0.2–15 wt. parts, per 100 wt. parts of total monomer constituting the binder resin.

The binder resin may be synthesized through a polymerization process, such as solution polymerization, emulsion polymerization or suspension polymerization.

Among the above, emulsion polymerization is a process wherein a substantially water-insoluble monomer is dispersed in minute droplets in aqueous medium and polymerized by using a water-soluble polymerization initiator. In this process, the control of reaction heat is easy, and a polymerization phase (i.e., an oil phase comprising a polymer and a monomer) is a phase separate from the dispersion medium phase (water) to provide a lower termination reaction speed, which allows a high polymerization speed and provides a polymer of a high polymerization degree. Moreover, the polymerization process is relatively simple, and fine particulate polymerizate particles are obtained, thus allowing easy blending with other toner ingredients, such as a colorant and a charge control agent. These are advantageous features as a process for producing toner binder resin.

However, according to the emulsion polymerization, the product polymer is liable to be contaminated with an emulsifier added, and the recovery of the polymerizate requires a separation step as by salting out. In order to obviate such difficulties, suspension polymerization is convenient.

In the suspension polymerization, at most 100 wt. parts, preferably 10–90 wt. parts, of a monomer may be dispersed in 100 wt. parts of an aqueous medium in the presence of a dispersing agent, such as polyvinyl alcohol (or partially saponified polyvinyl acetate), or calcium phosphate in a proportion of, e.g., 0.05–1 wt. part per 100 wt. parts of the aqueous medium. The polymerization temperature may be around 50–95° C. and may suitably be selected depending on the initiator used and objective polymer.

It is preferred that the binder resin used in the present invention is formed through polymerization in the presence of a polyfunctional polymerization initiator alone or in combination with a mono-functional polymerization initiator.

Specific examples of the polyfunctional polymerization initiator may include: polyfunctional polymerization initiators having two or more polymerization-initiating functional groups, such as peroxide groups, in one molecule, inclusive of: 1,1-di-t-butylperoxy-3,3,5-trimethylcyclohexane, 1,3-bis(t-butylperoxyisopropyl)benzene, 2,5-dimethyl-2,5-(t-butylperoxy)hexane, tris(t-butylperoxy)triazine, 1,1-di-t-butylperoxycyclohexane, 2,2-di-t-butylperoxy-butane, 4,4-di-t-butylperoxyvaleric acid-n-butyl ester, di-t-butyl peroxyhexahydroterephthalate, di-t-butyl peroxyazelate, di-t-butyl peroxytrimethyl-adipate, 2,2-bis(4,4-di-t-butylperoxycyclohexyl)-propane, and 2,2-t-butylperoxyoctane; and polyfunctional polymerization initiators having both a polymerization-initiating functional group, such as a peroxide group, and a polymerizable unsaturated group, inclusive of: diallyl peroxydicarbonate, t-butyl-peroxymaleic acid, t-butyl peroxyallylcarbonate, and t-butyl peroxyisopropylfumarate.

Among the above, preferred examples may include: 1,1-d-t-butylperoxy-3,3,5-trimethylcyclo-hexane, 1,1-di-t-butylperoxy-cyclohexane, di-t-butyl peroxyhexahydroterephthalate, di-t-butyl peroxazelate, 2,2-bis(4,4-di-t-butylperoxycyclohexyl)propane, and t-butyl peroxyallylcarbonate.

Such a polyfunctional polymerization initiator may preferably be used in combination with a mono-functional polymerization initiator so as to provide a toner binder resin satisfying various performances. It is particularly preferred to use a mono-functional polymerization initiator having a 10-hour halflife decomposition temperature (i.e., a decomposition temperature giving a halflife of 10 hours) lower than that of the polyfunctional polymerization initiator used in combination therewith. Specific examples of such a mono-functional polymerization initiator may include: organic peroxides, such as benzoyl peroxide, 1,1-di-(t-butylperoxy)-3,3,5-trimethylcyclohexane, n-butyl 4,4-di(t-butylperoxy)valerate, dicumyl peroxide, α,α'-bis(t-butylperoxydiisopropyl)benzene, t-butylperoxy-cumene, and di-t-butylperoxide; and azo and diazo compounds, such as azobisisobutyronitrile, and diazoaminoazobenzene.

Such a mono-functional polymerization initiator can be added into the monomer simultaneously with the polyfunctional polymerization initiator but may preferably be added to the polymerization system after the lapse of the halflife of the polyfunctional polymerization initiator in order to ensure the proper function and efficiency of the polyfunctional polymerization initiator.

The polymerization initiator(s) may preferably be used in 0.05–2 wt. parts per 100 wt. parts of the monomer in view of the efficiency.

It is also preferred that the binder resin includes a crosslinked structure formed by using a crosslinking monomer. The crosslinking monomer may principally comprise a monomer having two or more polymerizable double bonds. Examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene (2)-2,2-bis(4-hydroxyphenyl)propanedi-acrylate, polyoxyethylene(4)-2,2-bis(4-hydroxyphenyl)-propanediacrylate, and compounds obtained by substituting methacrylate groups for the acrylate groups in the above compounds; and polyester-type diacrylate compounds, such as one known by a trade name of MANDA (available from Nihon Kayaku K. K.). Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

Such a crosslinking agent may be used in an amount of 0.00001–1 wt. part, preferably 0.001–0.5 wt. part, per 100 wt. parts of the other monomers for constituting the binder resin.

Among the crosslinking monomers, aromatic divinyl compounds, particularly divinylbenzene, and diacrylate compounds bonded by a chain including an aromatic group and an ether bond, are particularly preferred.

As another process for synthesizing the binder resin, it is also possible to use bulk polymerization or solution polymerization. The bulk polymerization can provide a low-molecular weight polymer by accelerating the termination reaction speed by polymerization at a high temperature but is accompanied with a difficulty of reaction control. In contrast thereto, the solution polymerization can easily provide a polymer of a desired molecular weight under a moderate condition by utilizing a difference in chain-transfer function depending on a solvent and adjusting an initiator amount or a reaction temperature, and is therefore preferred. It is also preferred to effect the solution polymerization under an increased pressure in order to minimize the amount of the initiator and minimize the adverse effect attributable to the remaining of the polymerization initiator.

In the case of using a polyester resin as a binder resin, such a polyester resin may be produced from the following alcohol and acid components.

Examples of dihydric alcohol component may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenol derivatives represented by the following formula (E):

(E)

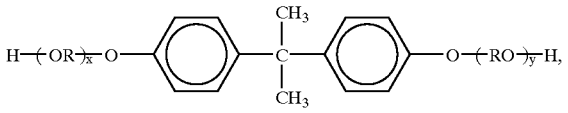

wherein R denotes an ethylene or propylene group, x and y are independently an integer of at least 0 with the proviso that the average of x+y is in the range of 0–10; diols represented by the following formula (F):

(F)

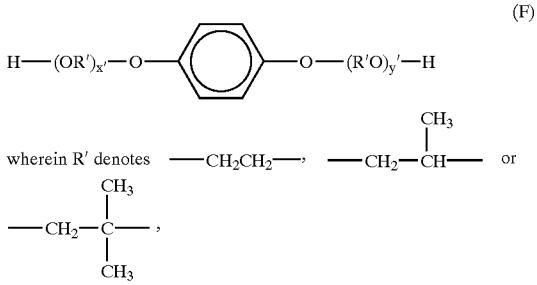

and x' and y' are independently an integer of at least 0 with the proviso that the average of x'+y' is in the range of 0–10.

Examples of a dibasic acid may include: benzenedicarboxylic acids and anhydrides and lower alkyl esters thereof, such as phthalic acid, terephthalic acid, isophthalic acid, and phthalic anhydride; alkyldicarboxylic acids, such as succinic acid, adipic acid, sebacic acid, and azelaic acid, and their anhydrides and lower alkyl esters thereof; and unsaturated dicarboxylic acids, such as fumaric acid, maleic acid, citraconic acid and itaconic acid, and their anhydrides and lower alkyl esters thereof.

It is possible to include a polycarboxylic acid and/or a polyhydric alcohol having three or more functional groups functioning as a crosslinking component.

Examples of the polyhydric alcohol having at least three hydroxyl groups may include: sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of the polycarboxylic acid having at least three carboxyl groups may include polycarboxylic acids and derivatives thereof inclusive of: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetriolcarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, empole trimmer acid, and anhydrides and lower alkyl esters of these; and tetracarboxylic acids represented by a formula below and, anhydrides and lower alkyl esters thereof:

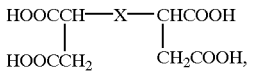

wherein X denotes an alkylene group or alkenylene group having 5–30 carbon atoms and having at least one side chain having at least 3 carbon atoms.

The polyester resin may preferably comprise 40–60 mol. %, more preferably 45–55 mol. %, of alcohol, and 60–40 mol. %, more preferably 55–45 mol. % of acid. It is preferred to include the poly-hydric alcohol and/or polybasic carboxylic acid having at least 3 functional groups in a proportion of 5–60 mol. % of the total alcohol and acid components.

The polyester resin may be produced through ordinary polycondensation.

The magnetic toner of the present invention may further contain a wax, examples of which may include: aliphatic hydrocarbon waxes, such as low-molecular weight polyethylene, low-molecular weight polypropylene, polyolefin copolymers, polyolefin wax, microcrystalline wax, paraffin wax, and Fischer-Tropsche wax oxides of aliphatic hydrocarbon waxes, such as oxidized polyethylene wax, and block copolymers of these; waxes principally comprising aliphatic acid esters, such as montaic acid ester wax and castor wax; vegetable waxes, such as candelilla wax, carnauba wax and wood wax; animal waxes, such as bees wax, lanolin and whale wax; mineral waxes, such as ozocerite, ceresine, and petroractum; partially or wholly de-acidified aliphatic acid esters, such as deacidified carnauba wax. Further examples may include: saturated linear aliphatic acids, such as palmitic acid, stearic acid and montaic acid and long-chain alkylcarboxylic acids having longer chain alkyl groups; unsaturated aliphatic acids, such as brassidic acid, eleostearic acid and valinaric acid; saturated alcohols, such as stearyl alcohol, eicosy alcohol, behenyl alcohol, carnaubyl alcohol, ceryl alcohol and melissyl alcohol and long-chain alkyl alcohols having longer chain alkyl groups; polybasic alcohols, such as sorbitol, aliphatic acid amides, such as linoleic acid amide, oleic acid amide, and lauric acid amide; saturated aliphatic acid bisamides, such as methylene-bisstearic acid amide, ethylene-biscopric acid amide, ethylene-bislauric acid amide, and hexamethylene-bisstearic acid amide; unsaturated aliphatic acid amides, such as ethylene-bisoleic acid amide, hexamethylene-bisoleic acid amide, N,N'-dioleyladipic acid amide, and N,N-dioleylsebacic acid amide; aromatic bisamides, such as m-xylene-bisstearic acid amide, and N,N'-distearylisophthalic acid amide; aliphatic acid metal soaps (generally called metallic soaps), such as calcium stearate, calcium stearate, zinc stearate and magnesium stearate; waxes obtained by grafting vinyl monomers such as styrene and acrylic acid onto aliphatic hydrocarbon waxes; partially esterified products between aliphatic acid and polyhydric alcohols, such as behenic acid monoglyceride; and methyl ester compounds having hydroxyl groups obtained by hydrogenating vegetable oil and fat.

It is also preferred to use a wax having a narrower molecular weight distribution or a reduced amount of impurities, such as low-molecular weight solid aliphatic acid, low-molecular weight solid alcohol, or low-molecular weight solid compound, by the press sweating method, the solvent method, recrystallization, vacuum distillation, supercritical gas extraction or fractionating crystallization.

The magnetic toner according to the present invention contains magnetic iron oxide, which also functions as a colorant. The magnetic iron oxide may comprise particles of an iron oxide, such as magnetite, maghemite or ferrite. It is also preferable to use such magnetic iron oxide particles also containing a non-iron element at their surface or inside thereof in a proportion of 0.05–10 wt. %, more preferably 0.1–5 wt. % of Fe.

It is preferred to include a non-iron element selected from magnesium, silicon, phosphorus and sulfur. Examples of another non-iron element may include: lithium, beryllium, boron, germanium, titanium, zirconium, tin, lead, zinc, calcium, barium, scandium, vanadium, chromium, manganese, cobalt, copper, nickel, gallium, indium, silver, palladium, gold, mercury, platinum, tungsten, molybdenum, niobium, osmium, strontium, yttrium, and technetium.

Such a magnetic iron oxide may preferably be contained in a proportion of 20–200 wt. parts, further preferably 50–150 wt. parts, per 100 wt. parts of the binder resin.

The magnetic iron oxide may preferably have a number-average particle size (D1) of 0.05–1.0 $\mu$m, further preferably 0.1–0.5 $\mu$m. The magnetic iron oxide may preferably have a BET specific surface area ($S_{BET}$) of 2–40 $m^2/g$, more preferably 4–20 $m^2/g$, and may have any particle shape. As for magnetic properties, the magnetic iron oxide may preferably have a saturation magnetization ($\sigma_s$) of 10–200 $Am^2/kg$, more preferably 70–100 $Am^2/kg$, as measured at a magnetic field of 795.8 kA/m; a residual magnetization of 1–100 $Am^2/kg$, more preferably 2–20 $Am^2/kg$; and a coercive force (Hc) of 1–30 kA/m, more preferably 2–15 kA/m.

The number-average particle size values (D1) of magnetic iron oxide described herein refer to a number-average of Martin diameters (lengths of chords taken in a fixed direction and each dividing an associated particle projection area into equal halves) of 250 magnetic iron oxide particles arbitrarily selected on pictures (at a magnification of $4\times10^4$) taken through a transmission electron microscope. The magnetic properties of magnetic iron oxide may be measured by using an oscillation type magnetometer (e.g., "VSMP-1", made by Toei Kogyo K. K.). As a measurement method, 0.1–0.15 of magnetic iron oxide is accurately weighed at an accuracy of ca. 1 mg by a directly indicating balance and subjected to a measurement in an environment of ca. 25° C. by applying an external magnetic field of 795.8 kA/m (10 kilo-oersted) at a sweeping rate for drawing a hysteresis curve in ten minutes.

The magnetic toner of the present invention may preferably have a density of 1.3–2.2 $g/cm^3$, more preferably 1.4–2.0 $mg/cm^2$, particularly preferably 1.5–1.85 $g/cm^3$. The density (and therefore the weight) of a magnetic toner is related with a magnetic force, an electrostatic force and a gravity acting on the magnetic toner, and the density in the above-mentioned range is preferred so as to provide a good balance between the charging and magnetic force due to appropriate function of the magnetic iron oxide, thus exhibiting an excellent developing performance.

In case where the magnetic toner has a density below 1.3 $g/cm^3$, the magnetic iron oxide exerts only a weak function onto the magnetic toner, thus being liable to result in a low magnetic force. As a result, the electrostatic force of causing the magnetic toner to jump onto the photosensitive drum becomes predominant to result in an overdeveloping state causing fog and an increased toner consumption. On the other hand, at a density in excess of 2.2 $g/cm^3$, the magnetic iron oxide exerts a strong function on the magnetic toner, the magnetic force becomes predominant over the electrostatic force, and also the magnetic toner becomes heavy, so that the flying of the magnetic toner from the developing sleeve onto the photosensitive drum, thus resulting in insufficient developing states inclusive of lower image density and inferior image quality.

The density of a magnetic toner may be measured according to various method, and the values described herein are values measured according to the gas substitution method using helium by using a meter ("ACCUPYC", made by K. K. Shimadzu Seisakusho) as an exact and convenient method.

For the measurement, 4 g of a sample magnetic toner is placed in a stainless steel-made cell having an inner diameter of 18.5 mm, a length of 39.5 mm and a volume of 10 $cm^3$. Then, the volume of the magnetic toner sample in the cell is measured by tracing a pressure change of the helium to calculate a density of the magnetic toner sample based on the weight and volume of the sample magnetic toner.

The magnetic iron oxide used for providing the magnetic toner according to the present invention may have been treated with a silane coupling, a titanate coupling agent or an aminosilane, as desired.

The magnetic toner according to the present invention may preferably contain a charge control agent.

As negative charge control agents for providing a negatively chargeable tone, organometallic complexes or chelate compounds, for example, are effective. Examples thereof may include: monoazo metal complexes, metal complexes of aromatic hydroxy-carboxylic acids, and metal complexes of aromatic dicarboxylic acids. Other examples may include: aromatic hydroxycarboxylic acids, aromatic mono- and polycarboxylic acids, and metal salts, anhydride, and esters of these acids, and bisphenol derivatives A preferred class of monoazo metal compounds may be obtained as complexes of monoazo dyes synthesized from phenol or naphthol having a substituent such as alkyl, halogen, nitro or carbamoyl with metals, such as Cr, Co and Fe. It is also possible to use metal compounds of aromatic carboxylic acids, such as benzene-, naphthalene-, anthracene- and phenanthrene-carboxylic acids having a substituent of alkyl, halogen, nitro, etc.

As a specific class of negative charge control agents, it is preferred to use an azo metal complex of formula (I) below:

(I)

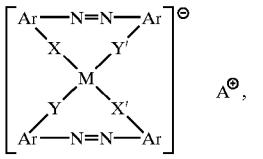

wherein M denotes a coordination center metal selected from the group consisting of Sc, V, Cr, Co, Ni, Mn, Fe, Ti and Al; Ar denotes an aryl group capable of having a substituent, selected from include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^{\oplus}$ denotes a hydrogen, sodium, potassium, ammonium or aliphatic ammonium ion or a mixture of such ions.

On the other hand, examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologues inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate guanidine compounds; and imidazole compounds. These may be used singly or in mixture of two or more species. Among the above, it is preferred to use a triphenylmethane compound or a quaternary ammonium salt having a non-halogen counter ion. It is also possible to use a homopolymer or a copolymer with a polymerizable monomer, such as styrene, acrylate ester or methacrylate ester as mentioned above of a monomer represented by the following formula (II):

(II)

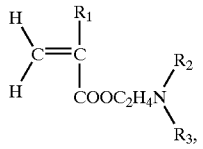

wherein $R_1$ denotes H or $CH_3$, and $R_2$ and $R_3$ denote a substituted or non-substituted alkyl group (of preferably $C_1$–$C_4$). In this case, such a homopolymer or copolymer may function as a charge control agent and also as a part or whole of the binder resin.

Such a charge control agent may be integrally incorporated in or externally added to toner particles in an amount which may vary depending on the species of the binder resin, other additives and toner production processes inclusive of dispersion method but may preferably be 0.1–10 wt. parts, more preferably 0.1–5 wt. parts, per 100 wt. parts of the binder resin.

The toner of the present invention may contain a flowability-improving agent externally added to toner particles. Examples thereof may include: fine powders of fluorine-containing resins, such as polyvinylidene fluoride and polytetrafluoroethylene; fine powders of inorganic oxides such as wet-process silica, dry-process silica, titanium oxide and alumina, and surface-treated products of these inorganic oxide fine powders treated with silane compounds, titanate coupling agent and silicone oil.

Further examples may include: fine powders of inorganic materials, inclusive of oxides, such as zinc oxide and tin oxide; complex oxides, such as strontium titanate, barium titanate, calcium titanate, strontium zirconate and calcium zirconate; and carbonates, such as calcium carbonate and magnesium carbonate.

It is preferred to use a so-called dry-process silica or fumed silica, which is fine powdery silica formed by vapor-phase oxidation of a silicone halide, e.g., silicon tetrachloride. The basic reaction may be represented by the following scheme:

$$SiCl_4+2H_2+O_2 \rightarrow SiO_2+4HCl.$$

In the reaction step, another metal halide, such as aluminum chloride or titanium, can be used together with the silicon halide to provide complex fine powder of silica and another metal oxide, which can be also used as a type of silica as a preferred flowability-improving to be used in the toner of the present invention. The flowability-improving agent may preferably have an average primary particle size of 0.001–2 $\mu$m, more preferably 0.002–0.2 $\mu$m.

Examples of commercially available silica fine powder products formed by vapor-phase oxidation of silicon halides may include those available under the following trade names.

| | |
|---|---|
| Aerosil (Nippon Aerosil K.K.) | 130 |
| | 200 |
| | 300 |
| | 380 |
| | TT600 |
| | MOX170 |
| | MOX80 |
| | COK84 |
| Ca-O-SiL (Cabot Co.) | M-5 |
| | MS-7 |
| | MS-75 |
| | HS-5 |
| | EH-5 |
| Wacker HDK N20 (Wacker-Chemie CMBH) | V15 |
| | N20E |
| | T30 |
| | T40 |
| D-C Fine Silica (Dow Corning Co.) | |
| Fransol (Fransil Co.) | |

It is further preferred to use such silica fine powder after a hydrophobization treatment. It is particularly preferred to use such a hydrophobized silica fine powder showing a hydrophobicity in a range of 30–80 as measured by the methanol titration test.

The hydrophobization may be effected to treating the silica fine powder with an organosilicon compound reactive with or physically adsorbed by the silica fine powder.

Examples of the organosilicon compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilyl-mercaptan, triorganosilyl acrylates, vinyldimethyl-acetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylsiloxanes having 2–12 siloxane units per molecule including terminal units each having one hydroxyl group connected to Si; and further silicone oils, such as dimethylsilicone oil. These organosilicon compounds may be used singly, or in mixture, or in succession of two or more species.

The flowability-improving agent may preferably have a specific surface area as measured by the BET method using nitrogen adsorption ($S_{BET}$) of at least 30 $m^2/g$, more preferably at least 50 $m^2/g$. The flowability-improving agent may preferably be used in a proportion of 0.01–8 wt. parts, more preferably 0.1–4 wt. parts, per 100 wt. parts of the toner. The $S_{BET}$ values described herein are based on values measured by using "GEMINI 2375" (made by K. K. Shimadzu Seisakusho) in a similar manner as the magnetic toner particles.

In a preferred process for producing the magnetic toner of the present invention, a coarsely crushed powdery feed of melt-kneaded toner ingredients is pulverized by a mechanical pulverizer as described before, and the pulverized particles are introduced into a classification step to provide a classified product comprising a mass of toner particles having a desired particle size. In the classification step, it is preferred to use a multi-division pneumatic classifier including at least three zones for recovery of fine powder, medium powder and coarse powder. For example, in the case of using a three-division pneumatic classifier, the feed powder is classified into three types of fine powder, medium powder and coarse powder. In the classification step using such a classified medium powder is recovered while removing the coarse powder comprising particles having sizes larger than the prescribed range and the fine powder comprising particles having sizes smaller than the prescribed range, and the medium powder is recovered as toner particles which may be used as they are as a toner product or blended with an external additive, such as hydrophobic colloidal silica to provide a toner.

The fine powder removed in the classification step and comprising particles having particle size below the prescribed range is generally recycled for re-utilization to the melt-kneading step for providing a coarsely pulverized melt-kneaded product comprising toner ingredients. An ultrafine powder having a further smaller particle size than the fine powder and occurring in a slight amount in the pulverization step and the classification is similarly recycled for re-utilization to the melt-kneading step, or discarded. Further, a coarse powder having a larger particle size than the preferred particle size is recycled to the pulverization step and melt-kneading step for re-utilization.

Figure 2:
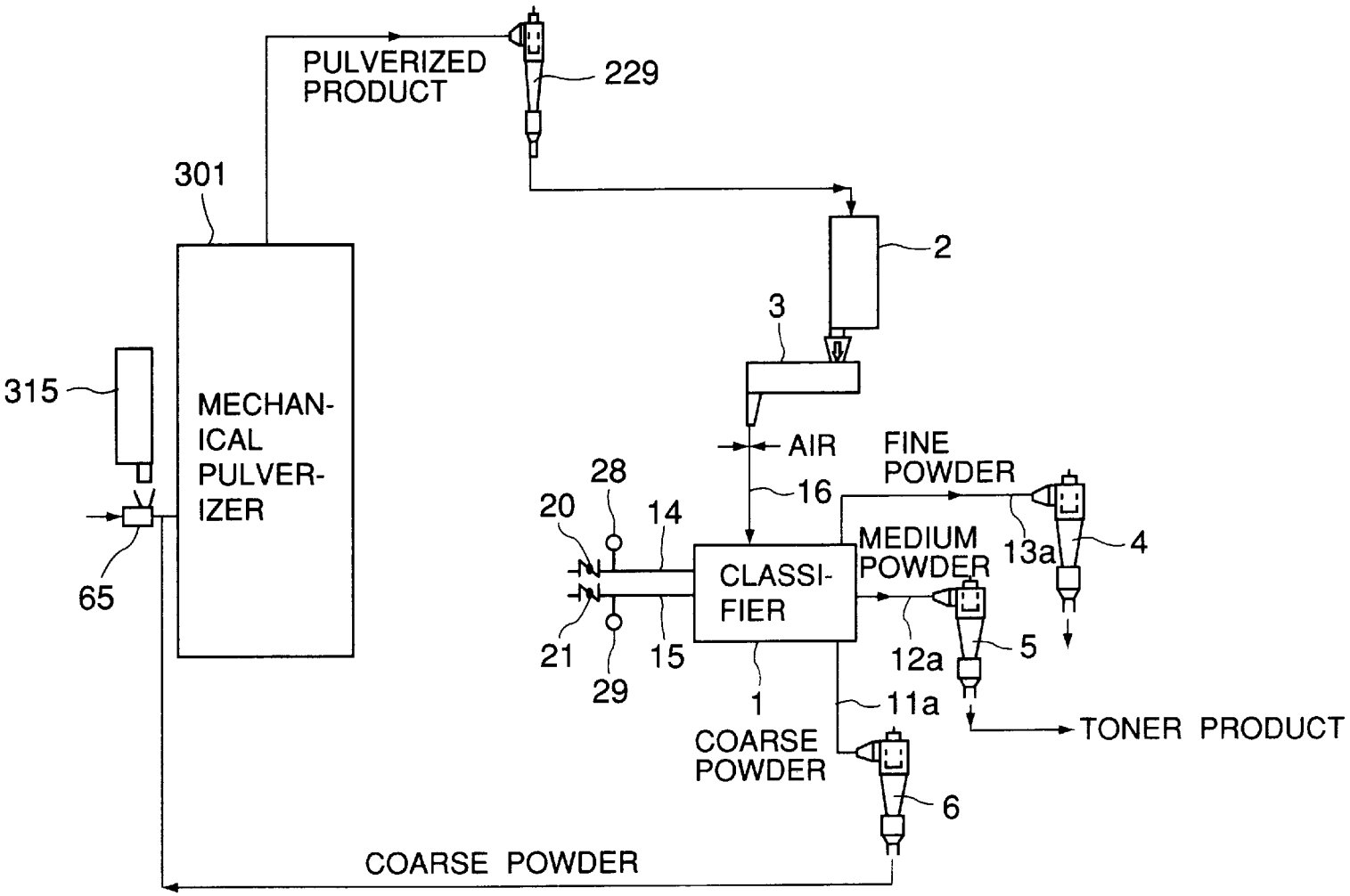
FIG. 2 illustrates an example of the apparatus system for practicing a toner production process.

FIG. 2 illustrates an embodiment of such a toner production apparatus system. In the apparatus system, a powdery feed comprising at least a binder resin and magnetic iron oxide is supplied. For example, a binder resin and magnetic iron oxide are melt-kneaded, cooled and coarsely crushed to form such a powdery feed.

Referring to FIG. 2, the powdery feed is introduced at a prescribed rate to a mechanical pulverizer 301 as pulverization means via a first metering feeder 315. The introduced powdery feed is instantaneously pulverized by the mechanical pulverizer 301, introduced via a collecting cyclone 329 to a second metering feeder 2 and then supplied to a multi-division pneumatic classifier 1 via a vibration feeder 3 and a feed supply nozzle 16.

In the apparatus system, the feed rate to the multi-division pneumatic classifier, via the second metering feeder 2, may preferably be set to 0.7–1.7 times, more preferably 0.7–1.5 times, further preferably 1.0–1.2 times, the feed rate to the mechanical pulverizer 301 from the first metering feeder, in view of the toner productivity and production efficiency.

Figure 6:
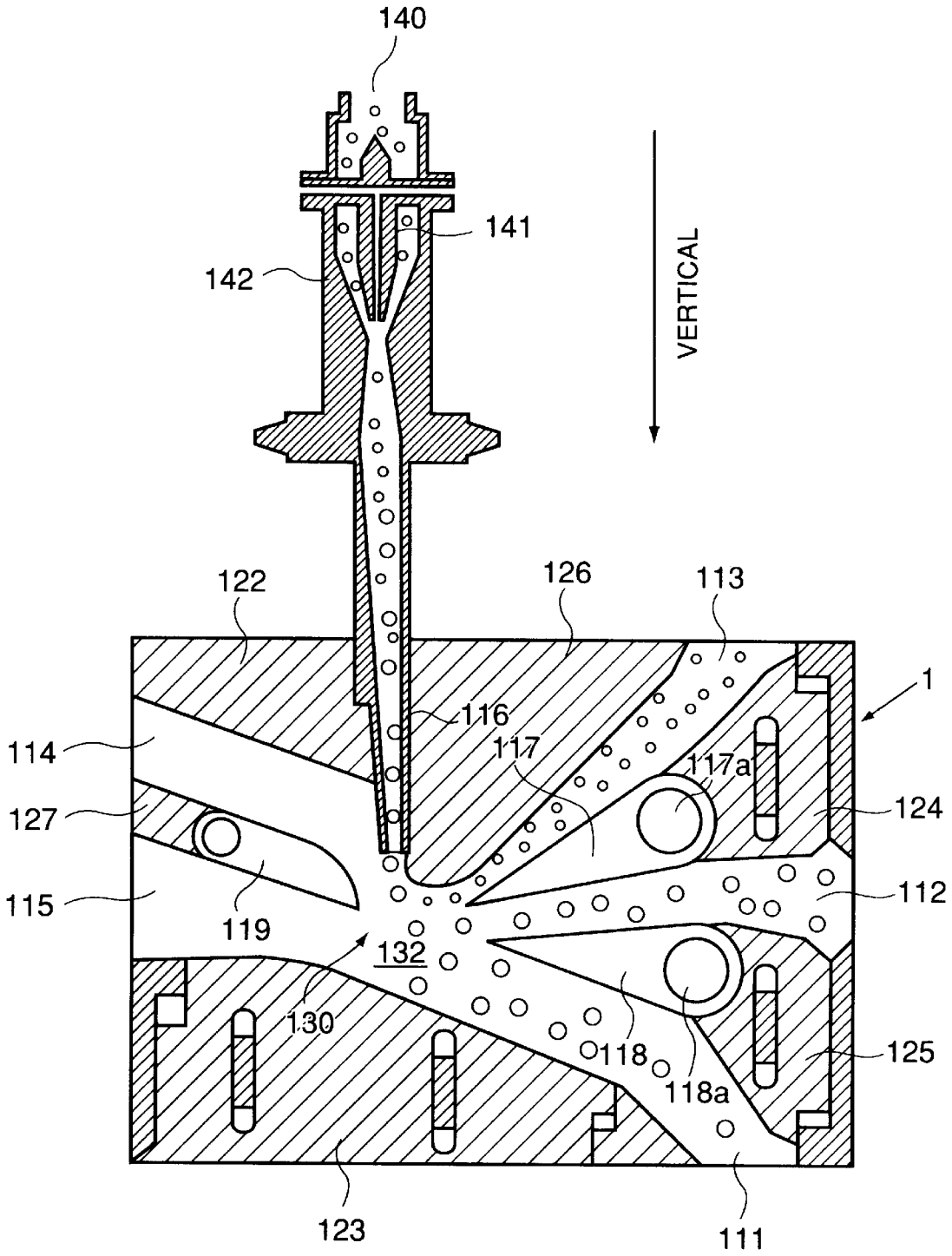
FIG. 6 is a schematic sectional view of a multi-division pneumatic classifier used in a toner classification step.

A pneumatic classifier is generally incorporated in an apparatus system while being connected with other apparatus through communication means, such as pipes. FIG. 2 illustrates a preferred embodiment of such an apparatus system. The apparatus system shown in FIG. 2 includes the multi-division classifier 1 (the details of which are illustrated in FIG. 6), the metering feeder 2, the vibration feeder 3, and collecting cyclones 4, 5 and 6, connected by communication means.

In the apparatus system, the pulverized feed is supplied to the metering feeder 2 and then introduced into the three-division classifier 1 via the vibration feeder 3 and the feed supply nozzle 16 at a flow speed of 10–350 m/sec. The three-division classifier 1 includes a classifying chamber ordinarily measuring 10–50 cm×10–50 cm×3–50 cm, so that the pulverized feed can be classified into three types of particles in a moment of 0.1–0.01 sec or shorter. By the classifier 1, the pulverized feed is classified into coarse particles, medium particles and fine particles. Thereafter, the coarse particles are sent out of an exhaust pipe 1*a* to a collecting cyclone 6 and then recycled to the mechanical pulverizer 301. The medium particles are sent through an exhaust pipe 12*a* and discharge out of the system to be recovered by a collecting cyclone 5 as a toner product. The fine particles are discharged out of the system via an exhaust pipe 13*a* and are discharged out of the system to be collected by a collecting cyclone 4. The collected fine particles are supplied to a melt-kneading step for providing a powdery feed comprising toner ingredients for re-utilization. The collecting cyclones 4, 5 and 6 can also function as a suction vacuum generation means for introducing by sucking the pulverized feed to the classifier chamber via the feed supply nozzle. The classifier 1 is provided with intake pipes 14 and 15 for introducing air thereinto, which are in turn provided with a first air introduction adjust means 20 and a second air introduction adjust means 21, like dampers, and static pressure gauges 28 and 29, respectively.

The rate of re-introduction of the coarse particles to the mechanical pulverizer 301 from the pneumatic classifier 1 may preferably be set to 0–10.0 wt. %, more preferably 0–5.0 wt. %, of the pulverized feed supplied from the second metering feeder 2 in view of the toner productivity. If the rate of re-introduction exceeds 10.0 wt. %, the powdery dust concentration in the mechanical pulverizer 301 is raised to increase the load on the pulverizer 301.

In order to produce a toner having a weight-average particle size (D4) of 4.5–11 $\mu$m and a narrow particle size distribution, the pulverized product out of the mechanical pulverizer may preferably satisfy a particle size distribution including a weight-average particle size of 4–12 $\mu$m, at most 70% by number, more preferably at most 65% by number of particles of at most 4.0 $\mu$m, and at most 40% by volume, more preferably at most 35% by volume, of particles of at least 10.1 $\mu$m. Further, the medium particles classified out of the classifier 1 may preferably satisfy a particle size distribution including a weight-average particle size of 4.5–11 $\mu$m, at most 40% by number, more preferably at most 35% by number of particles of at most 4.0 $\mu$m, and at most 35% by volume, more preferably at most 30% by volume, of particles of at least 10.1 $\mu$m.

Next, a pneumatic classifier as a preferred classification means for toner production, is described.

FIG. 6 is a sectional view of an embodiment of a preferred multi-division pneumatic classifier.

Referring to FIG. 6, the classifier includes a side wall 122 and a G-block 123 defining a portion of the classifying chamber, and classifying edge blocks 124 and 125 equipped with knife edge-shaped classifying edges 117 and 118. The G-block 123 is disposed slidably laterally. The classifying edges 117 and 118 are disposed swingably about shafts 117*a* and 118*a* so as to change the positions of the classifying edge tips. The classifying edge blocks 117 and 118 are slidable laterally so as to change horizontal positions relatively together with the classifying edges 117 and 118. The classifying edges 117 and 118 divide a classification zone 130 of the classifying chamber 132 into 3 sections.

A feed port 140 for introducing a powdery feed is positioned at the nearest (most upstream) position of a feed supply nozzle 116, which is also equipped with a high-pressure air nozzle 141 and a powdery feed-introduction nozzle 142 and opens into the classifying chamber 132. The nozzle 116 is disposed on a right side of the side wall 122, and a Coanda block 126 is disposed so as to form a long elliptical arc with respect to an extension of a lower tangential line of the feed supply nozzle 116. A left block 127 with respect to the classifying chamber 132 is equipped with a gas-intake edge 119 projecting rightwards in the classifying chamber 132. Further, gas-intake pipes 114 and 115 are disposed on the left side of the classifying chamber 132 so as to open into the classifying chamber 132. Further, the gas-intake pipes 114 and 115 (14 and 15 in FIG. 2) are equipped with first and second gas introduction control means 20 and 21, like dampers, and static pressure gauges 28 and 29 (as shown in FIG. 2).

The positions of the classifying edges 117 and 118, the G-block 123 and the gas-intake edge 118 are adjusted depending on the pulverized powdery feed to the classifier and desired particle size of the product toner.

On the right side of the classifying chamber 132, there are disposed exhaust ports 111, 112 and 113 communicative with the classifying chamber corresponding to respective classified fraction zones. The exhaust ports 111, 112 and 113 are connected with communication means such as pipes (11*a*, 12*a* and 13*a* as shown in FIG. 2) which can be provided with shutter means, such as valves, as desired.

The feed supply nozzle 116 may comprise an upper straight tube section and a lower tapered tube section. The inner diameter of the straight tube section and the inner diameter of the narrowest part of the tapered tube section may be set to a ratio of 20:1 to 1:1, preferably 10:1 to 2:1, so as to provide a desirable introduction speed.

The classification by using the above-organized multi-division classifier may be performed in the following manner. The pressure within the classifying chamber 132 is reduced by evacuation through at least one of the exhaust ports 111, 112 and 113. The powdery feed is introduced through the feed supply nozzle 116 at a flow speed of preferably 10–350 m/sec under the action of a flowing air caused by the reduced pressure and an ejector effect caused by compressed air ejected through the high-pressure air supply nozzle and ejected to be dispersed in the classifying chamber 132.

The particles of the powdery feed introduced into the classifying chamber 132 are caused to flow along curved lines under the action of the Coanda effect exerted by the Coanda block 126 and the action of introduced gas, such as air, so that coarse particles form an outer stream to provide a first fraction outside the classifying edge 118, medium particles form an intermediate stream to provide a second fraction between the classifying edges 118 and 117, and fine particles form an inner stream to provide a third fraction inside the classifying edge 117, whereby the classified coarse particles are discharged out of the exhaust port 111, the medium particles are discharge out of the exhaust port 112 and the fine particles are discharged out of the exhaust port 113, respectively.

In the above-mentioned powder classification, the classification (or separation) points are principally determined by the tip positions of the classifying edges 117 and 118 corresponding to the lowermost part of the Coanda block 126, while being affected by the suction flow rates of the classified air stream and the powder ejection speed through the feed supply nozzle 116.

According to the above-mentioned toner production system, it is possible to effectively produce a toner having a weight-average particle size of 4.5–11 $\mu$m, and a narrow particle size distribution by controlling the pulverization and classification conditions.

To supplement the toner production process, the magnetic toner of the present invention is provided from toner ingredients including at least the binder resin and the magnetic iron oxide, but other ingredients, such as a charge control agent, a colorant, a wax and other additives may be included as desired. These ingredient are sufficiently blended by a blender, such as a Henschel mixer or a ball mill, and then melt-kneaded through a hot kneading means, such as a roller, a kneader or an extruder, to disperse the magnetic iron oxide and optional additives in the melted binder resin and wax. After being solidified by cooling, the melt-kneaded product is pulverized and classified to produce toner particles. The toner particle production may preferably be performed by using an apparatus system as described with reference to FIGS. 2 to 6, but can be effected by using another process and various machines. Several examples of commercially available are enumerated below together with the makers thereof. For example, the commercially available blenders may include: Henschel mixer (mfd. by Mitsui Kozan K. K.), Super Mixer (Kawata K. K.), Conical Ribbon Mixer (Ohkawara Seisakusho K. K.); Nautamixer, Turbulizer and Cyclomix (Hosokawa Micron K. K.); Spiral Pin Mixer (Taiheiyo Kiko K. K.), Lodige Mixer (Matsubo Co. Ltd.). The kneaders may include: Buss Cokneader (Buss Co.), TEM Extruder (Toshiba Kikai K. K.), TEX Twin-Screw Kneader (Nippon Seiko K. K.), PCM Kneader (Ikegai Tekko K. K.); Three Roll Mills, Mixing Roll Mill and Kneader (Inoue Seisakusho K. K.), Kneadex (Mitsui Kozan K. K.); MS-Pressure Kneader and Kneadersuder (Moriyama Seisakusho K. K.), and Bambury Mixer (Kobe Seisakusho K. K.). As the pulverizers, Cowter Jet Mill, Micron Jet and Inomizer (Hosokawa Micron K. K.); IDS Mill and PJM Jet Pulverizer (Nippon Pneumatic Kogyo K. K.); Cross Jet Mill (Kurimoto Tekko K. K.), Ulmax (Nisso Engineering K. K.), SK Jet O. Mill (Seishin Kigyo K. K.), Krypron (Kawasaki Jukogyo K. K.), Turbo Mill (Turbo Kogyo K. K.), and Super Rotor (Nisshin Engineering K. K.). As the classifiers, Classiell, Micron Classifier, and Spedic Classifier (Seishin Kigyo K. K.), Turbo Classifier (Nisshin Engineering K. K.); Micron Separator and Turboplex (ATP); Micron Separator and Turboplex (ATP); TSP Separator (Hosokawa Micron K. K.); Elbow Jet (Nittetsu Kogyo K. K.), Dispersion Separator (Nippon Pneumatic Kogyo K. K.), YM Microcut (Yasukawa Shoji K. K.). As the sieving apparatus, Ultrasonic (Koei Sangyo K. K.), Rezona Sieve and Gyrosifter (Tokuju Kosaku K. K.), Ultrasonic System (Dolton K. K.), Sonicreen (Shinto Kogyo K. K.), Turboscreener (Turbo Kogyo K. K.), Microshifter (Makino Sangyo K. K.), and circular vibrating sieves.

Next, an embodiment of the process cartridge is described with reference to FIG. 16.

The process cartridge comprises at least a developing means and an (electrostatic latent) image-bearing member integrally supported to form a unit (a cartridge) detachably mountable to a main assembly of an image forming apparatus, such as a copying machine, a laser beam printer, or a facsimile apparatus.

Figure 16:
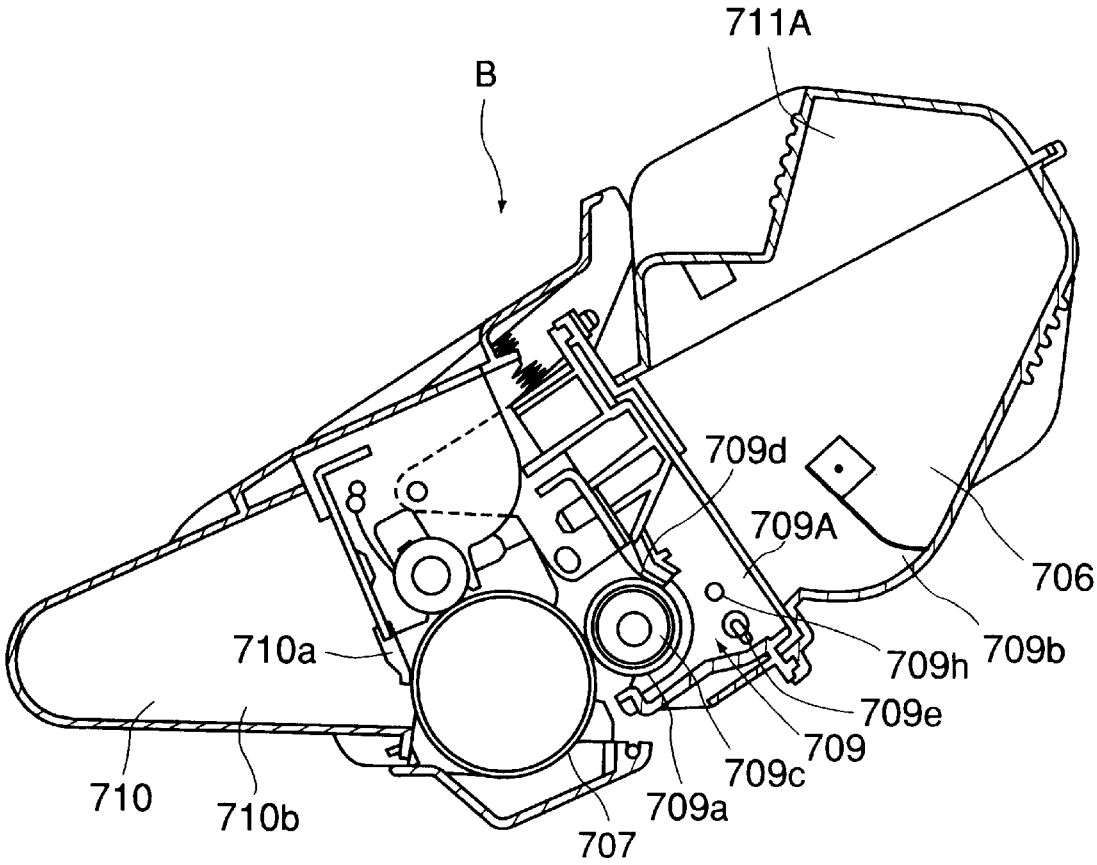
FIG. 16 is a schematic view of an embodiment of the process cartridge according to the invention.

FIG. 16 illustrates a process cartridge B including a developing means 709, a drum-shaped image-bearing member (photosensitive drum 707), a cleaning means 710 including a cleaning blade 710*a* and a waste toner reservoir 710*b*, and a contact charging means 708 as a primary charging means, which are integrally supported.

In this embodiment, the developing means 709 incudes a toner vessel 711 containing a magnetic toner 706 therein, a toner feed member 709*b* for feeding the magnetic toner 706 to a developing chamber 709A, a developing sleeve 709*a* disposed half in the developing chamber 709A and opposite to the photosensitive drum 707, a fixed magnet 709*c* disposed inside the sleeve 709*a*, a toner stirring member disposed in the developing chamber 709A, and a regulating blade 709*d* as a toner layer thickness-regulating means disposed opposite to the developing sleeve 709*a*. At the time of development, a developing bias voltage is applied to the developing sleeve 709*a* from a bias voltage application means (not shown) to form a prescribed electric field between the developing sleeve 709*a* and the image-bearing member 707. Under the action of the bias electric field, the magnetic toner 706 carried in a layer on the developing sleeve 709*a* is transferred onto the image-bearing member 707 to effect the development. In order to suitably practice the developing step, the developing sleeve 709*a* is disposed with a prescribed gap from the image-bearing member 707, and the toner layer thickness on the developing sleeve is preferably controlled to be smaller than the prescribed gap.

In the embodiment shown in FIG. 16, four members of the developing means 709, the image-bearing member 707, the cleaning means 710 and the primary charging means 708, are integrally supported to form a process cartridge. However, the process cartridge of the present invention can be basically formed to include at least two members of the developing means and the image-bearing member. Thus, it is also possible to form a process cartridge including three member of the developing means, the image-bearing member and the cleaning means; or the developing means, the image-bearing member and the primary charging means, or to form a process cartridge further including another member.

Hereinbelow, the present invention will be described with reference to Examples, which however should not be construed to restrict the scope of the present invention.

EXAMPLE 1

A styrene-acrylate resin comprising a copolymer of 72.5 wt. parts of styrene, 20 wt. parts of n-butyl acrylate, 7 wt. parts of mono-n-butylmaleate and 0.5 wt. part of divinylbenzene was used as a binder resin. The styrene-acrylate resin exhibited g glass transition temperature according to DSC (Tg) of 58° C., an acid value of 23.0 mgKOH/g, a number-average molecular weight (Mn) of 6300 and a weight-average molecular weight (Mw) of 415000. Including the styrene-acrylate resin, toner ingredients were formulated as follows.

| | |
|---|---|
| Styrene-acrylate resin | 100 wt. parts |
| Magnetic iron oxide ($D1 = 0.20\ \mu m$, $S_{BET} = 8.0\ m^2/g$, $Hc = 3.7\ kA/m$, $\delta_s = 82.3\ Am^2/kg$, $\delta_r = 4.0\ Am^2/kg$) | 95 wt. parts |
| Polypropylene wax (Tmp = 143° C., penetration = 0.5 mm (at 25° C.)) | 4 wt. parts |
| Charge-control agent (Fe-complex of azo compound having t-butyl substituent) | 2 wt. parts |

The above ingredients were melt-kneaded by a twin-screw extruder heated at 130° C., and then cooled and coarsely crushed by a hammer mill. The crushed powdery feed was subjected to pulverization by means of a mechanical pulverizer ("TURBOMILL", made by Turbo Kogyo K. K.) having an organization as illustrated in FIGS. 3 to 5 after remodeling of including a stator and a rotor each comprising a carbon steel S45C surface-coated with a wear-resistant layer of Ni—Cr self-fluxing alloy showing a Vickers hardness of 1000. The rotor and the stator were disposed with a gap of 1.3 mm, and the rotor was rotated at a peripheral speed of 110 m/s. The coarsely crushed powdery feed was warmed to 40° C. before introduction to the mechanical pulverizer, and the pulverization was performed at an inlet temperature T1 of −8° C. and an outlet temperature T2 of 55° C. The resultant pulverizate was subjected to classification ("ELBOW JET", made by Nittetsu Kogyo K. K.) having an organization as illustrated in FIG. 6 to recover Toner particles 1 as a medium powder fraction while strictly removing a coarse powder fraction and a fine powder fraction. Toner particles 1 thus obtained exhibited a BET specific surface area ($S_{BET}$) of 1.00 $m^2/g$.

Toner particles 1 in 100 wt. parts were blended with 1.2 wt. parts of hydrophobic silica fine powder treated with dimethylsilicone oil and hexamethyldisilazane and exhibiting $S_{BET}$=110 $m^2/g$ and a methanol wettability ($W_{Me}$) of 68% by means of a Henschel mixer to obtain Magnetic toner 1.

Figure 10:
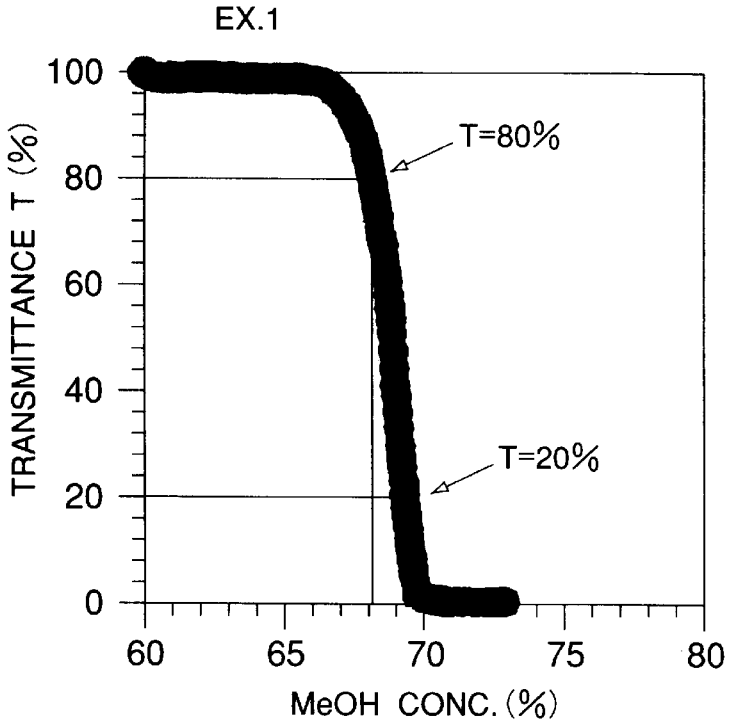
FIGS. 10, 11, 12 and 13 show transmittance curves representing methanol wettability characteristics of magnetic toners of Example 1, and Comparative Examples 1, 2 and 3, respectively.
Figure 14:
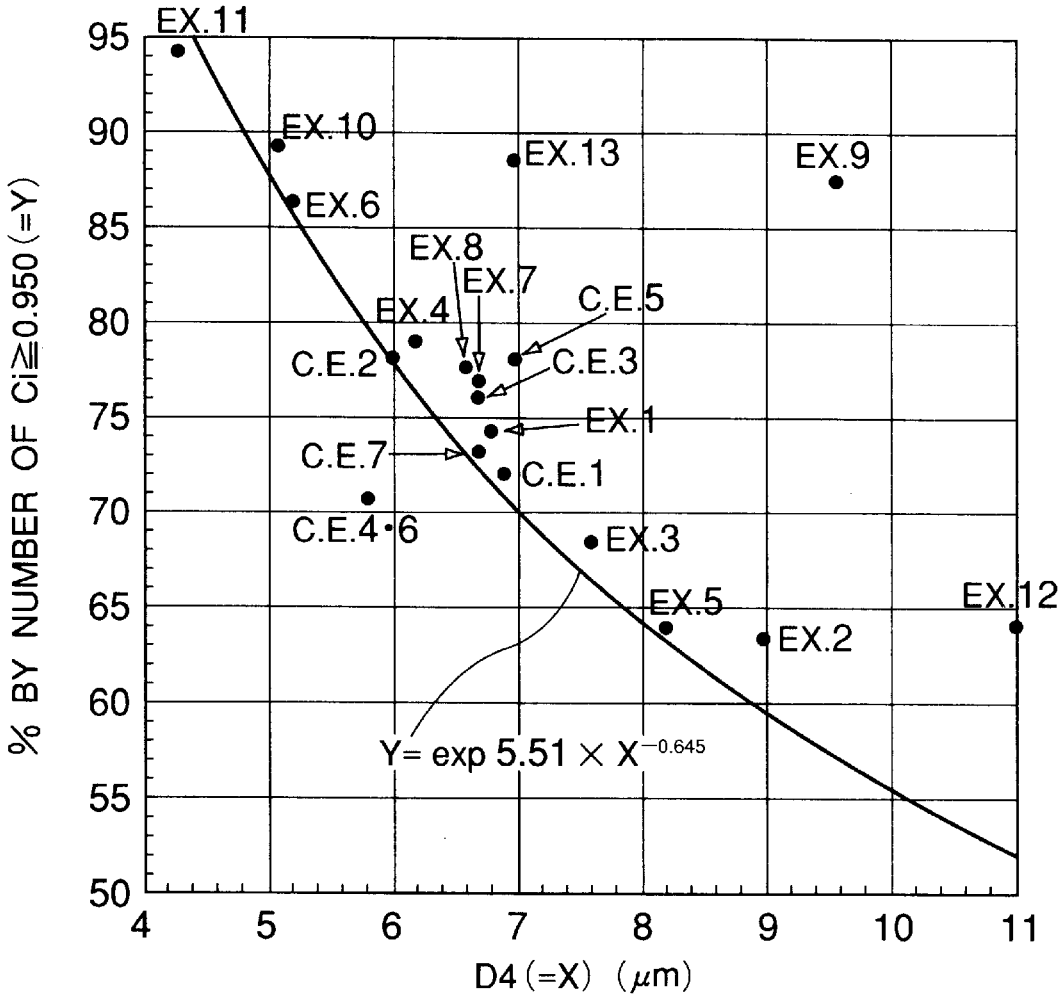
FIG. 14 is a graph showing a relationship between particle size (X) and % by number (Y) of particles having a circularity (Ci)≧0.950.
Figure 15:
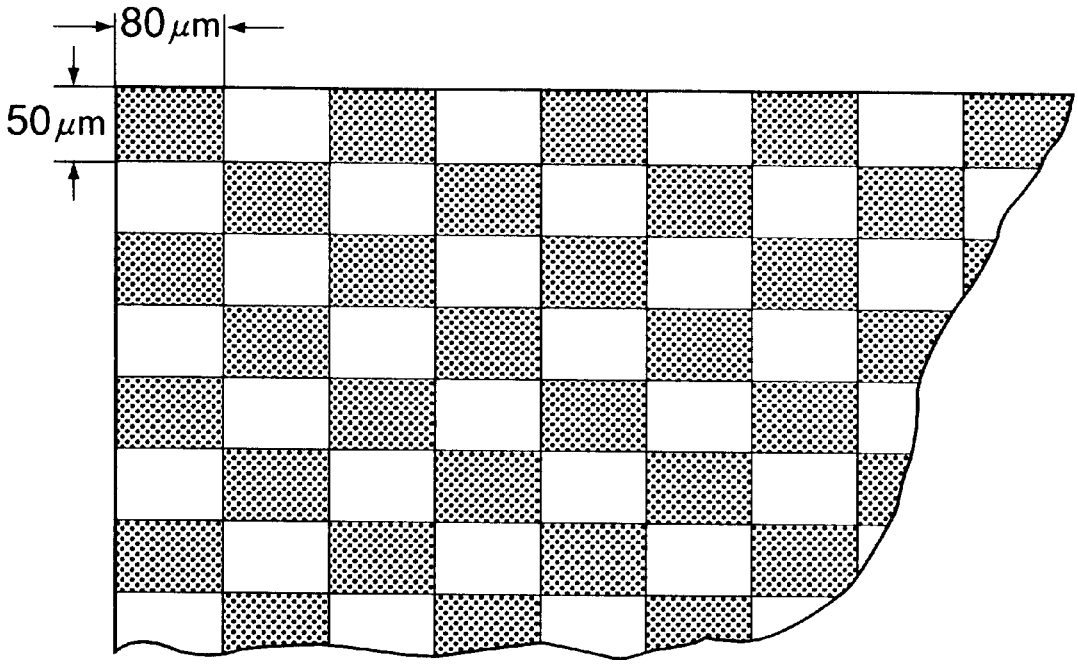
FIG. 15 illustrates a dot reproducibility test pattern.

Magnetic toner 1 exhibited a density (d) of 1.70 $g/cm^3$, a weight-average particle size (D4) of 6.8 $\mu$m, and circularity (Ci) distributions including a number-basis percentage of Ci≧0.900 (N % (Ci≧0.900)) of 95.1% and a number-basis percentage of Ci≧0.950 (N % (Ci≧0.900)) of 74.2%. Regarding the methanol titration transmittance characteristics, Magnetic toner 1 exhibited a methanol concentration at 80%-transmittance ($C_{MeOH}$ % (T=80%)) of 68.0% and a methanol concentration at 20%-transmittance ($C_{MeOH}$ % (T=20%)) of 69%. The above-mentioned data and some additional data are shown in Table 2 together with those of Examples and Comparative Examples described hereinafter. The methanol titration transmittance curve is reproduced in FIG. 10, and a plot showing a correlation of N % (Ci≧0.950) (=Y) and D4 (=X) is shown in FIG. 14 together with those of Examples and Comparative Examples described hereinafter.

(Image Forming Test)

Magnetic toner 1 was introduced in a process cartridge having a structure as shown in FIG. 16, and the cartridge was incorporated in a laser beam printer ("LBP950", made by Canon K. K.; a process speed=144.5 mm/sec, corresponding to 32 A4-size lateral sheets/min) to effect continual image forming tests in a low temperature/low humidity environment (LT/LH=15° C./10% RH), a normal temperature/normal humidity environment (NT/NH=23° C./60% RH) and a high temperature/high humidity environment (HT/HH=32.5° C./80%RH). Image forming performances were evaluated with respect to the following items, and the evaluation results are inclusively shown in Table 3 together with those of Examples and Comparative Examples described hereinafter.

(1) Image Density

In the respective environments, a continual image forming test was performed on 20000 A4-size plain paper sheets (75 $g/m^2$) according to an intermittent mode including a cycle of printing on two sheets and pause for two-sheet period, and the image density on the first sheet and the 20000th sheet were measured by a Macbeth reflection densitometer (made by Macbeth Co.).

(2) Fog

A printed image for reproducing a white solid image on the 20000th sheet of plain paper (75 $m^2/g$) in the LT/LH environment was subjected to measurement of a whiteness by a reflectometer ("TC-6DS", made by Tokyo Denshoku K. K.), and the measured whiteness (%) was subtracted from a whiteness (%) of blank plain paper measured in the same manner to provide a fog (%). A larger fog value represents a larger degree of fog.

(3) Negative Ghost

Figure 7:
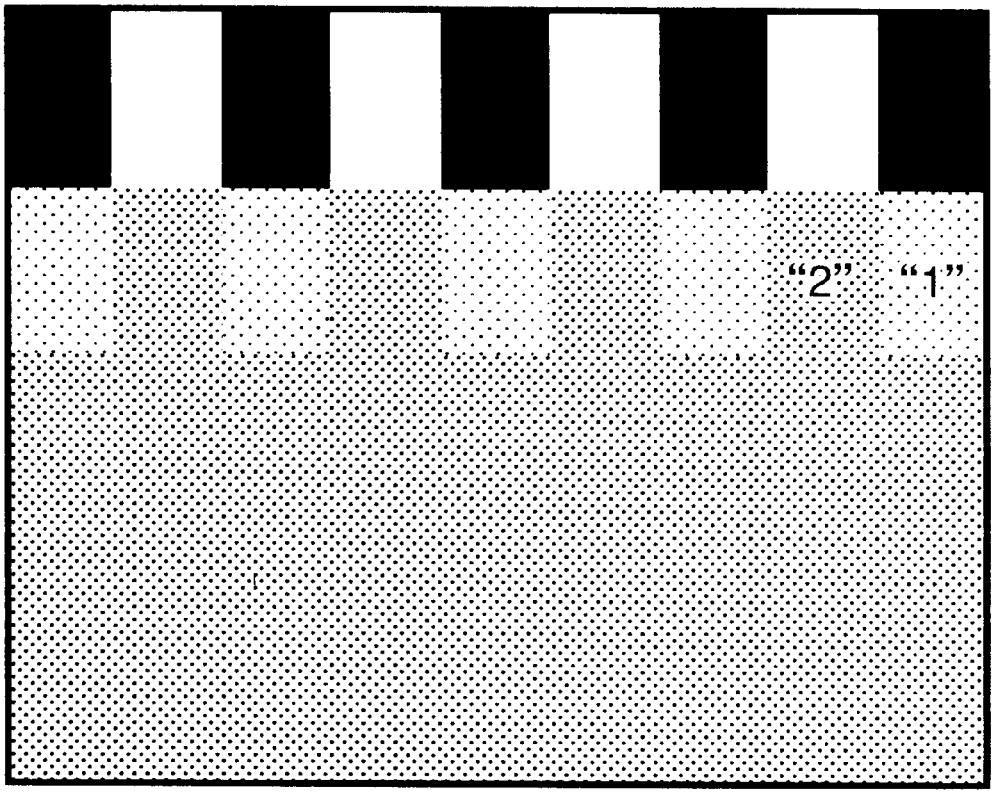
FIGS. 7 and 8 illustrate a negative ghost and a positive ghost, respectively.
Figure 8:
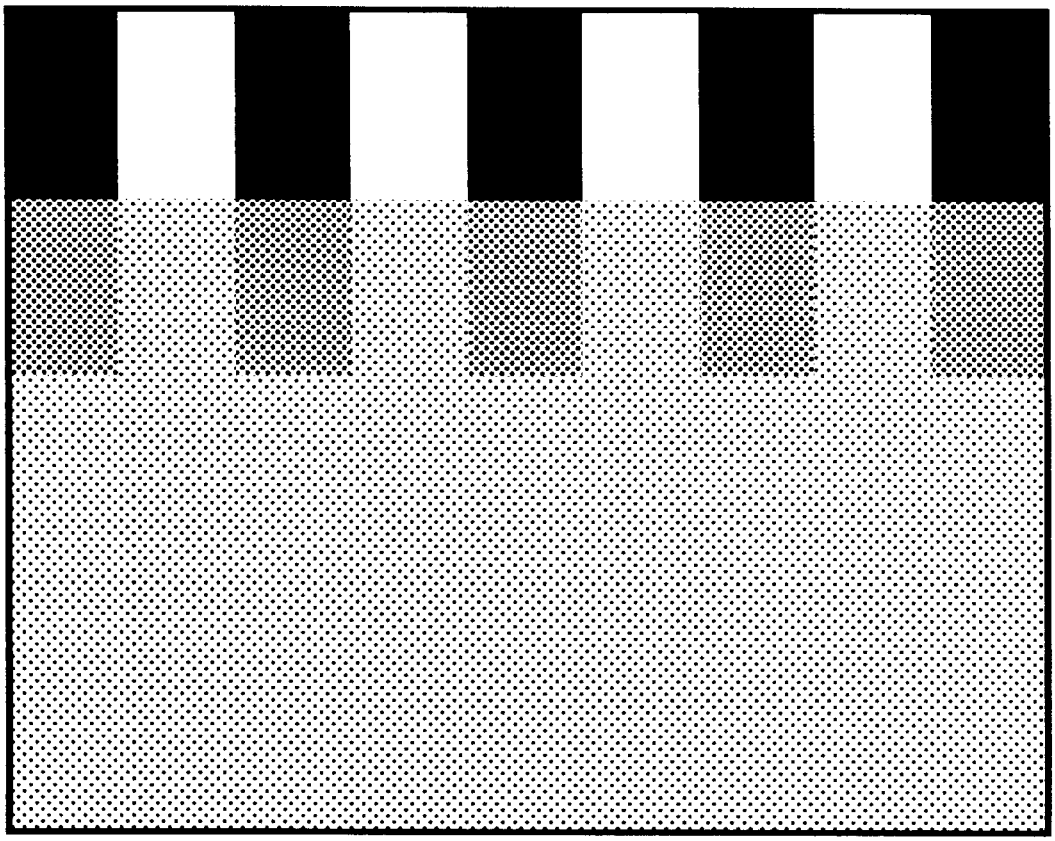

Negative ghost was evaluated at the time of printing on a 10000th sheet in the LT/LH environment. A test pattern as shown in FIG. 7 was used. More specifically, a pattern of alternating black and white stripes was reproduced for a length of one circumference of photosensitive drum revolution on a first portion of plain paper (75 $g/m^2$), and then a solid halftone image (composed of altrenation of a lateral black line of one-dot width (42 $\mu$m) and a lateral white line (space) of two-dot width (84 $\mu$m)) was reproduced on a subsequent portion of the plain paper. Then, in the reproduced halftone image portion corresponding to the second rotation circumference (i.e., immediately after the first rotation circumference giving the stripe pattern), a reflection image density of a portion immediately following a black stripe image ("1" in FIG. 7) was measured and subtracted from a reflection image density of a portion immediately following a white stripe image ("2" in FIG. 7) to provide a density difference ΔD. That is, ΔD=density at "2"−density at "1". Based on the value of the density difference, the negative ghost level was evaluated according to the following standard.

| | |
|---|---|
| A: | 0.0 ≦ ΔD < 0.02 |
| B: | 0.02 ≦ ΔD < 0.04 |
| C: | 0.04 ≦ ΔD < 0.06 |
| D: | 0.06 ≦ ΔD < 0.08 |
| E: | 0.08 ≦ ΔD |

(4) Dot Reproducibility (Dot)

After the continual printing on 20000 sheets in the NT/NH environment, a checker pattern (including 100 black dots each of 80 $\mu$m×50 $\mu$m) was printed, and the dot reproducibility was evaluated based on the number of fragmentarily or totally lacked dots according to the following standard:

| | |
|---|---|
| A: | at most 2 lacked dots/100 dots |
| B: | 3–5 lacked dots/100 dots |
| C: | 6–10 lacked dots/100 dots |
| D: | 11 or more lacked dots/100 dots |

(5) White Streaks

White streaks (as illustrate in FIG. 9) are liable to occur in an initial stage of printing especially in a low temperature/low humidity environment. Accordingly, a halftone image was printed on a 5tht sheet, a 100th sheet and a 500th sheet, and the halftone images were evaluated with respect to the presence or absence of white streaks according to the following standard.

| | |
|---|---|
| A: | White streaks were not observed or observed on only the 5th sheet. |
| B: | White streaks were observed on the 5th and 100th sheets but not on the 500th sheet. |
| C: | White streaks were observed on all the 5th, 100th and 500th sheets. |

EXAMPLE 2

Toner particles 2 and Magnetic toner 2 were prepared and evaluated in the same manner as in Example 1 except that the mechanical pulverizer conditions were changed to a rotor peripheral speed of 90 m/s, T1=−10° C. and T2=+54° C., and the classifying conditions were adjusted.

As a result, Toner particles 2 exhibited $S_{BET}$=0.96 $m^2/g$; and Magnetic toner 2 exhibited d=1.70 $g/cm^3$, D4=9.0 $\mu$m, N % (Ci≧0.900)=92.1%, N % (Ci≧0.950)=63.2%, $C_{MeOH}$ % (T=80%)=67.0%, $C_{MeOH}$ % (T=20%)=69%.

EXAMPLE 3

Toner particles 3 and Magnetic toner 3 were prepared and evaluated in the same manner as in Example 1 except that the mechanical pulverizer conditions were changed to T1=−13° C. and T2=+52° C., and the classifying conditions were adjusted.

As a result, Toner particles 3 exhibited $S_{BET}$=1.05 $m^2/g$; and Magnetic toner 3 exhibited d=1.70 $g/cm^3$, D4=7.6 μm, N % (Ci≧0.900)=94.8%, N % (Ci≧0.950)=68.3%, $C_{MeOH}$ % (T=80%) =66.2%, $C_{MeOH}$ % (T=20%)=67.7%.

EXAMPLE 4

Toner particles 4 and Magnetic toner 4 were prepared and evaluated in the same manner as in Example 1 except that the mechanical pulverizer conditions were changed to T1=−5° C. and T2=+58° C., and the classifying conditions were adjusted.

As a result, Toner particles 4 exhibited $S_{BET}$=0.82 $m^2/g$; and Magnetic toner 4 exhibited d=1.70 $g/cm^3$, D4=6.2 μm, N % (Ci≧0.900)=96.6%, N % (Ci≧0.950)=78.8%, $C_{MeOH}$ % (T=80%)=71.2%, $C_{MeOH}$ % (T=20%)=72.7%.

EXAMPLE 5

Toner particles 5 and Magnetic toner 5 were prepared and evaluated in the same manner as in Example 1 except that the amount of the magnetic iron oxide was reduced to 70 wt. parts per 100 wt. parts of the binder resin, the mechanical pulverizer conditions were changed to a rotor peripheral speed of 100 m/s, T1=−15° C. and T2=+53° C., and the classifying conditions were adjusted.

As a result, Toner particles 5 exhibited $S_{BET}$=1.03 $m^2/g$; and Magnetic toner 5 exhibited d=1.50 $g/cm^3$, D4=8.2 μm, N % (Ci≧0.900)=92.9%, N % (Ci≧0.950)=63.8%, $C_{MeOH}$ % (T=80%)=72.3%, $C_{MeOH}$ % (T=20%)=74.4%.

EXAMPLE 6

Toner particles 6 and Magnetic toner 6 were prepared and evaluated in the same manner as in Example 1 except that the amount of the magnetic iron oxide was increased to 140 wt. parts per 100 wt. parts of the binder resin, the mechanical pulverizer conditions were changed to a rotor peripheral speed of 120 m/s, T1=−10° C. and T2=+54° C., and the classifying conditions were adjusted.

As a result, Toner particles 6 exhibited $S_{BET}$=1.20 $m^2/g$; and Magnetic toner 6 exhibited d=2.00 $g/cm^3$, D4=5.2 μm, N % (Ci≧0.900)=98.5%, N % (Ci≧0.950)=86.2%, $C_{MeOH}$ % (T=80%)=65.4%, $C_{MeOH}$ % (T=20%)=66.8%.

EXAMPLE 7

Toner particles 7 and Magnetic toner 7 were prepared and evaluated in the same manner as in Example 1 except that the amount of the magnetic iron oxide was reduced to 40 wt. parts per 100 wt. parts of the binder resin, the mechanical pulverizer conditions were changed to T1=−15° C. and T2=+55° C., and the classifying conditions were adjusted.

As a result, Toner particles 7 exhibited $S_{BET}$=1.11 $m^2/g$; and Magnetic toner 7 exhibited d=1.30 $g/cm^3$, D4=6.7 μm, N % (Ci≧0.900)=95.5%, N % (Ci≧0.950)=76.8%, $C_{MeOH}$ % (T=80%)=73.9%, $C_{MeOH}$ % (T=20%)=78.1%.

EXAMPLE 8

Toner particles 8 and Magnetic toner 8 were prepared and evaluated in the same manner as in Example 1 except that the amount of the magnetic iron oxide was increased to 200 wt. parts per 100 wt. parts of the binder resin, the mechanical pulverizer conditions were changed to a rotor peripheral speed of 90 m/s, T1=−10° C. and T2=+56° C., and the classifying conditions were adjusted.

As a result, Toner particles 8 exhibited $S_{BET}$=1.03 $m^2/g$; and Magnetic toner 8 exhibited d=2.20 $g/cm^3$, D4=6.6 μm. N % (Ci≧0.900)=96.3%, N % (Ci≧0.950)=77.6%, $C_{MeOH}$ % (T=80%)=70.1%, $C_{MeOH}$ % (T=20%)=77.2%.

EXAMPLE 9

Toner particles 9 and Magnetic toner 9 were prepared and evaluated in the same manner as in Example 1 except that the mechanical pulverizer conditions were changed to a rotor peripheral speed of 90 m/s, T1=−3° C. and T2=+60° C., and the classifying conditions were adjusted.

As a result, Toner particles 9 exhibited $S_{BET}$=0.70 $m^2/g$; and Magnetic toner 9 exhibited d=1.70 $g/cm^3$, D4=9.6 μm, N % (Ci≧0.900)=97.3%, N % (Ci≧0.950)=87.3%, $C_{MeOH}$ % (T=80%)=70.7% $C_{MeOH}$ % (T=20%)=78.1%.

EXAMPLE 10

Toner particles 10 and Magnetic toner 10 were prepared and evaluated in the same manner as in Example 1 except that the mechanical pulverizer conditions were changed to a rotor peripheral speed of 120 m/s, T1=−10° C. and T2=+53° C., and the classifying conditions were adjusted.

As a result, Toner particles 10 exhibited $S_{BET}$=1.30 $m^2/g$; and Magnetic toner 10 exhibited d=1.70 g/cm , D4=5.1 μm, N % (Ci≧0.900)=95.0%, N % (Ci≧0.950)=89.1%, $C_{MeOH}$ % (T=80%)=63.6%, $C_{MeOH}$ % (T=20%)=69.5%.

EXAMPLE 11

Toner particles 11 and Magnetic toner 11 were prepared and evaluated in the same manner as in Example 1 except that the mechanical pulverizer conditions were changed to a rotor peripheral speed of 120 m/s, T1=−15° C. and T2=+54° C., and the classifying conditions were adjusted.

As a result, Toner particles 11 exhibited $S_{BET}$=1.21 $m^2/g$; and Magnetic toner 11 exhibited d=1.70 $g/cm^3$, D4=4.5 μm, N % (Ci≧0.900)=98.1%, N % (Ci≧0.950)=94.2%, $C_{MeOH}$ % (T=80%)=74.1%, $C_{MeOH}$ % (T=20%)=78.2%.

EXAMPLE 12

Toner particles 12 and Magnetic toner 12 were prepared and evaluated in the same manner as in Example 1 except that the mechanical pulverizer conditions were changed to a rotor peripheral speed of 90 m/s, T1=−15° C. and T2=+53° C., and the classifying conditions were adjusted.

As a result, Toner particles 12 exhibited $S_{BET}$=0.76 $m^2/g$; and Magnetic toner 12 exhibited d=1.70 $g/cm^3$, D4=11.0 μm, N % (Ci≧0.900)=91.9%, N % (Ci≧0.950)=63.7%, $C_{MeOH}$ % (T=80%)=62.3%, $C_{MeOH}$ % (T=20%)=67.7%.

EXAMPLE 13

Toner particles 13 and Magnetic toner 13 were prepared and evaluated in the same manner as in Example 1 except that the mechanical pulverizer conditions were changed to T1=−5° C. and T2=+60° C., and the classifying conditions were adjusted.

As a result, Toner particles 13 exhibited $S_{BET}$=0.91 $m^2/g$; and Magnetic toner 13 exhibited d=1.70 $g/cm^3$, D4=7.0 μm, N % (Ci≧0.900)=97.6%, N % (Ci≧0.950)=88.3%, $C_{MeOH}$ % (T=80%)=75.0%, $C_{MeOH}$ % (T=20%)=76.0%.

COMPARATIVE EXAMPLE 1

Toner particles 14 and Magnetic toner 14 were prepared and evaluated in the same manner as in Example 1 except that the mechanical pulverizer conditions were changed to T1=−27° C. and T2=+38° C., and the classifying conditions were adjusted.

As a result, Toner particles 14 exhibited $S_{BET}$=1.30 $m^2/g$; and Magnetic toner 14 exhibited d=1.70 $g/cm^3$, D4=6.9 μm, N % (Ci≧0.900)=94.6%, N % (Ci≧0.950)=72.0%, $C_{MeOH}$ % (T=80%)=62.8%, $C_{MeOH}$ % (T=20%)=66.2%.

COMPARATIVE EXAMPLE 2

Toner particles 15 and Magnetic toner 15 were prepared and evaluated in the same manner as in Example 1 except that the mechanical pulverizer conditions were changed to T1=+5° C. and T2=+65° C., and the classifying conditions were adjusted.

As a result, Toner particles 15 exhibited $S_{BET}$=0.72 $m^2/g$; and Comparative Magnetic toner 15 exhibited d=1.70 $g/cm^3$, D4=6.0 μm, N % (Ci≧0.900)=95.8%, N % (Ci≧0.950)=78.0%, $C_{MeOH}$ % (T=80%)=71.3%, $C_{MeOH}$ % (T=20%)=76.5%.

COMPARATIVE EXAMPLE 3

The toner production process in Example 1 was repeated up to the coarse crushing by the hammer mill. The crushed powdery feed was subjected to pulverization by means of a jet stream-type impingement pneumatic pulverizer, and the pulverizate was subjected to a surface modification by a mechanical impact-type surface-modifier machine ("HYBRIDIZER", made by Nara Kikai Seisakusho K. K.). The resultant powdery product was subjected to classification by a fixed wall-type pneumatic classifier to provide toner particles, which were further subjected to classification by means of a multi-division classifier ("ELBOW JET", made by Nittetsu Kogyo K. K.) for removal of ultrafine powder fraction and coarse powder fraction to recover Toner particles 16, which were blended with the same hydrophobic silica fine powder in the same manner as in Example 1 to provide magnetic toner 16.

Figure 11:
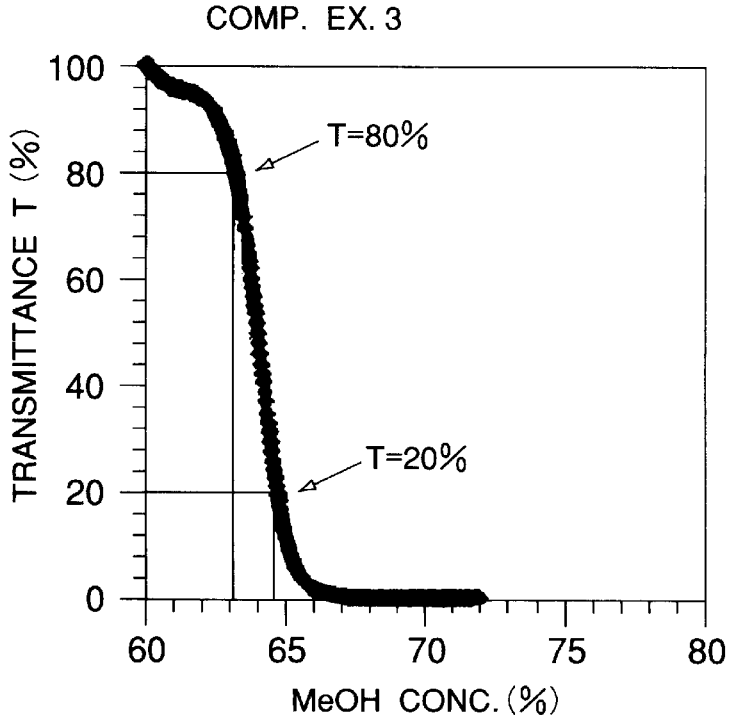

As a result, Toner particles 16 exhibited $S_{BET}$=0.80 $m^2/g$; and Magnetic toner 16 exhibited d=1.70 $g/cm^3$, D4=6.7 μm, N % (Ci≧0.900)=95.5%, N % (Ci≧0.950)=76.0%, $C_{MeOH}$ % (T=80%)=63.2%, $C_{MeOH}$ % (T=20%)=64.7%. The methanol titration transmittance curve as reproduced in FIG. 11.

Magnetic toner 16 was evaluated with respect to image forming performances in the same manner as in Example 1.

COMPARATIVE EXAMPLE 4

Toner particles 17 and Magnetic toner 17 were prepared and evaluated in the same manner as in Comparative Example 3 except for omitting the surface-modification by the impact-type surface-modifier machine ("HYBRIDIZER").

As a result, Toner particles 17 exhibited $S_{BET}$=1.70 $m^2/g$; and Magnetic toner 17 exhibited d=1.70 $g/cm^3$, D4=5.8 μm, N % (Ci≧0.900)=89.6%, N % (Ci≧0.950)=70.6%, $C_{MeOH}$ % (T=80%)<60%, $C_{MeOH}$ % (T=20%)=61.8%. The methanol titration transmittance curve is reproduced in FIG. 12.

COMPARATIVE EXAMPLE 5

The toner production process in Example 1 was repeated up to the coarse crushing by the hammer mill. The crushed powdery feed was subjected to pulverization by an impingement-type pneumatic pulverizer, a heat-treatment with a hot air stream at 300° C. and then classification to obtain Toner particles 18, which were blended with the same hydrophobic silica fine powder in the same manner as in Example 1 to provide Magnetic toner 18.

Figure 13:
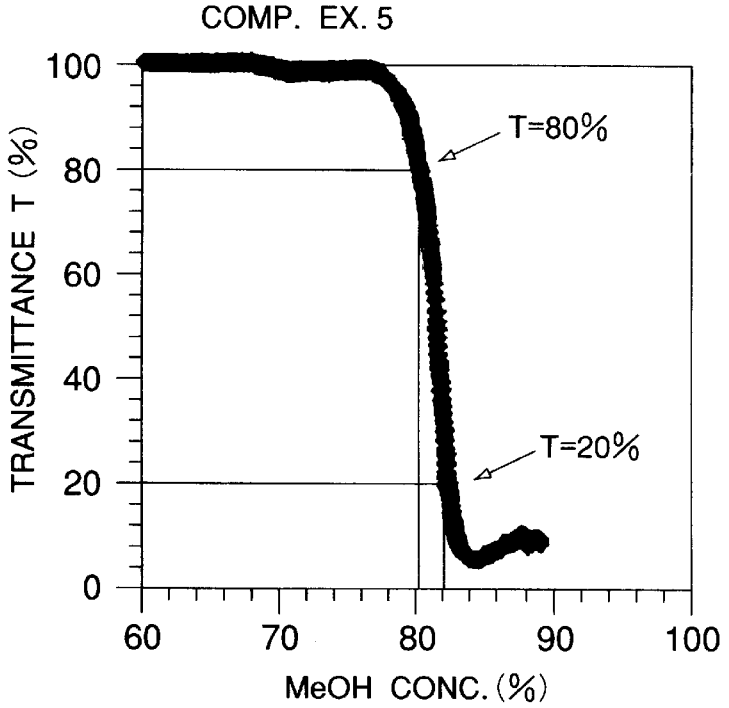

As a result, Toner particles 18 exhibited $S_{BET}$=0.65 $m^2/g$; and Magnetic toner 18 exhibited d=1.70 $g/cm^3$, D4=7.0 μm, N % (Ci≧0.900)=97.0%, N % (Ci≧0.950)=78.0%, $C_{MeOH}$ % (T=80%)=80.2%, $C_{MeOH}$ % (T=20%)=82.1%. The methanol titration transmittance curve is reproduced in FIG. 13.

Magnetic toner 18 was evaluated with respect to image forming performances in the same manner as in Example 1.

COMPARATIVE EXAMPLE 6

Magnetic toner 19 was prepared by blending 100 wt. parts of Toner particles 17 prepared in Comparative Example 4 with a high-hydrophobic silica fine powder instead of the hydrophobic silica fine powder used in Comparative Example 4 (i.e., the one used in Example 1). The high-hydrophobicity silica fine powder was prepared by hydrophobization with hexamethyldisilazane and dimethylsilicone oil having a viscosity of 100 centi-Stokes (at 25° C.) and resulted in a methanol titration transmittance curve (obtained in the same manner as that of the toner) exhibiting 97% transmittance at a methanol concentration of 72% by volume, 93%-transmittance at a methanol concentration of 74% by volume, 90%-transmittance at a methanol concentration of 75% by volume and 86%-transmittance at a methanol concentration of 76% by volume.

Magnetic toner 19 exhibited $C_{MeOH}$ % (T=80%)=61.1%, $C_{MeOH}$ % (T=20%)=64.3%.

COMPARATIVE EXAMPLE 7

Toner particles 20 and Magnetic toner 20 were prepared and evaluated in the same manner as in Example 1 except that the coarsely crushed powdery feed was introduced to the mechanical pulverizer at 20° C. without prior warming and the classifying conditions were adjusted.

As a result, Toner particles 20 exhibited $S_{BET}$=1.20 $m^2/g$; and Magnetic toner 20 exhibited d=1.70 $g/cm^3$, D4=6.7 μm, N % (Ci≧0.900)=94.8%, N % (Ci≧0.950)=73.1%, $C_{MeOH}$ % (T=80%)=63.9%, $C_{MeOH}$ % (T=20%)=65.8%.

TABLE 1

| | | Resin | Toner particles | | Toner | Mechanical Pulverizer | |
|---|---|---|---|---|---|---|---|
| Example | Toner | Tg (° C.) | $S_{BET}$ ($m^2/g$) | MeOH Conc. (%) at T = 80% | density ($g/cm^3$) | inlet temp. T1 (° C.) | outlet temp. T2 (° C.) |
| 1 | 1 | 58 | 1.00 | 67.0 | 1.70 | −8 | 55 |
| 2 | 2 | 58 | 0.96 | 63.0 | 1.70 | −10 | 54 |
| 3 | 3 | 58 | 1.05 | 61.0 | 1.70 | −13 | 52 |
| 4 | 4 | 58 | 0.82 | 71.0 | 1.70 | −5 | 58 |
| 5 | 5 | 58 | 1.03 | 70.6 | 1.50 | −15 | 53 |
| 6 | 6 | 58 | 1.20 | 64.2 | 2.00 | −18 | 45 |
| 7 | 7 | 58 | 1.11 | 72.8 | 1.30 | −15 | 55 |
| 8 | 8 | 58 | 1.03 | 68.7 | 2.20 | −10 | 56 |
| 9 | 9 | 58 | 0.70 | 69.1 | 1.70 | −3 | 60 |
| 10 | 10 | 58 | 1.30 | 63.6 | 1.70 | −10 | 53 |
| 11 | 11 | 58 | 1.21 | 73.0 | 1.70 | −15 | 54 |
| 12 | 12 | 58 | 0.76 | 63.9 | 1.70 | −15 | 53 |
| 13 | 13 | 58 | 0.91 | 74.5 | 1.70 | −5 | 60 |
| Comp. 1 | 14 | 58 | 1.30 | <60 | 1.70 | −27 | 38 |
| Comp. 2 | 15 | 58 | 0.72 | 70.4 | 1.70 | 5 | 65 |
| Comp. 3 | 16 | 58 | 0.80 | <60 | 1.70 | — | — |
| Comp. 4 | 17 | 58 | 1.70 | <60 | 1.70 | — | — |
| Comp. 5 | 18 | 58 | 0.65 | 78.8 | 1.70 | — | — |
| Comp. 6 | 19 | 58 | 1.70 | <60 | 1.70 | — | — |
| Comp. 7 | 20 | 58 | 1.20 | <60 | 1.70 | −10 | 53 |

TABLE 2

| | | Particle size distribution | | | Circularity (Ci) | | exp5.51 | MeOH Conc. (%) | |
|---|---|---|---|---|---|---|---|---|---|
| Example | Toner | X(=D4) (μm) | N % (≦4.0 μm) | V % (≧10.1 μm) | N % (≧0.900) | N % (≧0.950) = Y | × $X^{-0.645}$ | T = 80% | T = 20% |
| 1 | 1 | 6.8 | 20.0 | 2.2 | 95.1 | 74.2 | 71.7 | 68.0 | 69.2 |
| 2 | 2 | 9.0 | 11.3 | 14.2 | 92.1 | 63.2 | 59.9 | 67.0 | 69.0 |
| 3 | 3 | 7.6 | 13.1 | 7.2 | 94.8 | 68.3 | 66.8 | 66.2 | 67.7 |
| 4 | 4 | 6.2 | 25.6 | 2.0 | 96.6 | 78.8 | 76.2 | 71.2 | 72.7 |
| 5 | 5 | 8.2 | 15.0 | 11.0 | 92.9 | 63.8 | 63.6 | 72.3 | 74.4 |
| 6 | 6 | 5.2 | 43.2 | 1.1 | 98.5 | 86.2 | 85.3 | 65.4 | 66.8 |
| 7 | 7 | 6.7 | 18.5 | 2.5 | 95.5 | 76.8 | 72.5 | 73.9 | 75.8 |
| 8 | 8 | 6.6 | 22.7 | 1.3 | 96.3 | 77.6 | 73.2 | 70.1 | 75.6 |
| 9 | 9 | 9.6 | 10.3 | 7.3 | 97.3 | 87.3 | 57.5 | 70.7 | 75.7 |
| 10 | 10 | 5.1 | 29.8 | 0.8 | 95.0 | 89.1 | 86.4 | 65.8 | 69.5 |
| 11 | 11 | 4.3 | 33.1 | 0.5 | 98.1 | 94.2 | 96.5 | 74.1 | 75.9 |
| 12 | 12 | 11.0 | 8.0 | 16.8 | 91.9 | 63.7 | 52.6 | 65.5 | 67.7 |
| 13 | 13 | 7.0 | 18.8 | 2.7 | 97.6 | 88.3 | 68.6 | 75.0 | 76.0 |
| Comp. 1 | 14 | 6.9 | 21.2 | 1.9 | 94.6 | 72.0 | 71.1 | 62.8 | 66.2 |
| Comp. 2 | 15 | 6.0 | 22.8 | 1.0 | 95.8 | 78.0 | 77.8 | 71.3 | 76.5 |
| Comp. 3 | 16 | 6.7 | 20.0 | 3.2 | 95.5 | 76.0 | 72.5 | 63.2 | 64.7 |
| Comp. 4 | 17 | 5.8 | 24.0 | 1.6 | 97.9 | 70.6 | 80.2 | <60 | 61.8 |
| Comp. 5 | 18 | 7.0 | 11.6 | 1.8 | 97.0 | 78.0 | 68.6 | 80.2 | 82.1 |
| Comp. 6 | 19 | 5.8 | 24.0 | 1.6 | 94.9 | 70.6 | 80.2 | 61.1 | 64.3 |
| Comp. 7 | 20 | 6.7 | 21.0 | 1.9 | 94.8 | 73.1 | 72.5 | 63.9 | 65.8 |

TABLE 3

| | Image density | | | | | | |
|---|---|---|---|---|---|---|---|
| Example | LT/LH initial/ 20000th sheet | NT/NH initial/ 20000th sheet | HT/HH 20000th sheet | Fog (%) | Negative ghost | Dot | White streaks |
| 1 | 1.47/1.47 | 1.47/1.48 | 1.46/1.46 | 1.2 | A | A | A |
| 2 | 1.46/1.45 | 1.47/1.46 | 1.46/1.45 | 1.4 | A | A | A |
| 3 | 1.43/1.47 | 1.44/1.42 | 1.40/1.44 | 1.6 | A | A | A |
| 4 | 1.46/1.47 | 1.45/1.45 | 1.46/1.43 | 2.1 | B | B | A |
| 5 | 1.47/1.46 | 1.46/1.46 | 1.47/1.45 | 2.3 | B | B | A |
| 6 | 1.42/1.41 | 1.42/1.40 | 1.35/1.36 | 1.8 | A | B | B |
| 7 | 1.46/1.48 | 1.47/1.46 | 1.45/1.46 | 2.9 | A | B | B |
| 8 | 1.39/1.38 | 1.39/1.37 | 1.33/1.35 | 1.7 | B | B | A |
| 9 | 1.41/1.40 | 1.41/1.39 | 1.39/1.38 | 3.3 | B | C | B |
| 10 | 1.42/1.41 | 1.42/1.40 | 1.40/1.39 | 3.1 | A | A | C |

TABLE 3-continued

| Example | Image density LT/LH initial/ 20000th sheet | NT/NH initial/ 20000th sheet | HT/HH 20000th sheet | Fog (%) | Negative ghost | Dot | White streaks |
|---|---|---|---|---|---|---|---|
| 11 | 1.44/1.42 | 1.43/1.41 | 1.40/1.40 | 4.1 | C | A | C |
| 12 | 1.38/1.37 | 1.39/1.37 | 1.35/1.33 | 1.4 | A | C | A |
| 13 | 1.48/1.49 | 1.47/1.47 | 1.45/1.43 | 2.7 | C | B | B |
| Comp. 1 | 1.36/1.39 | 1.39/1.38 | 1.35/1.27 | 2.9 | B | C | B |
| Comp. 2 | 1.48/1.49 | 1.47/1.48 | 1.47/1.46 | 3.0 | C | C | B |
| Comp. 3 | 1.40/1.41 | 1.41/1.37 | 1.35/1.22 | 3.1 | D | B | D |
| Comp. 4 | 1.30/1.35 | 1.33/1.31 | 1.20/1.05 | 2.0 | A | D | E |
| Comp. 5 | 1.50/1.49 | 1.49/1.46 | 1.48/1.47 | 5.0 | E | D | B |
| Comp. 6 | 1.49/1.49 | 1.48/1.47 | 1.48/1.47 | 4.1 | D | D | E |
| Comp. 7 | 1.46/1.46 | 1.47/1.47 | 1.45/1.44 | 1.6 | A | C | C |

What is claimed is:

1. A magnetic toner, comprising: magnetic toner particles each comprising at least a binder resin and a magnetic iron oxide; wherein the magnetic toner shows a wettability characteristic in methanol/water mixture liquids such that it shows a transmittance of 80% for light at a wavelength of 780 nm at a methanol concentration in a range of 65–75% and a transmittance of 20% at a methanol concentration in a range of 66–76%.

2. The magnetic toner according to claim 1, wherein the magnetic toner has a weight-average particle size X in a range of 4.5–11.0 $\mu$m and contains at least 90% by number of particles having a circularity Ci according to formula (1) below of at least 0.900 with respect to articles of 2 $\mu$m or larger therein, $$Ci=L_0/L \quad (1),$$

wherein L denotes a peripheral length of a projection image of an individual particle, and $L_0$ denotes a peripheral length of a circle having an identical area as the projection image; and the magnetic toner contains a number-basis percentage Y (%) of particles having Ci≧0.950 within particles of 3 $\mu$m or larger satisfying:

$$Y \geqq X^{-0.645} \times exp\ 5.51 \quad (2).$$

3. The magnetic toner according to claim 1, wherein the magnetic toner particles have a BET specific surface area of 0.7–1.3 $m^2/g$.

4. The magnetic toner according to claim 1, wherein the magnetic toner has a density of 1.3–2.2 $g/cm^3$.

5. A process cartridge, detachably mountable to a main assembly of an image forming apparatus and comprising: at least an image-bearing member for bearing an electrostatic latent image thereon, and a developing means containing a magnetic toner for developing the electrostatic latent image on the image-bearing member with the magnetic toner to form a toner image;

wherein the magnetic toner comprises magnetic toner particles each comprising at least a binder resin and a magnetic iron oxide; and the magnetic toner shows a wettability characteristic in methanol/water mixture liquids such that it shows a transmittance of 80% for light at a wavelength of 780 nm at a methanol concentration in a range of 65–75% and a transmittance of 20% at a methanol concentration in a range of 66–76%.

6. The process cartridge according to claim 5, wherein the magnetic toner has a weight-average particle size X in a range of 4.5–11.0 $\mu$m and contains at least 90% by number of particles having a circularity Ci according to formula (1) below of at least 0.900 with respect to articles of 2 $\mu$m or larger therein, $$Ci=L_0/L \quad (1),$$

wherein L denotes a peripheral length of a projection image of an individual particle, and $L_0$ denotes a peripheral length of a circle having an identical area as the projection image; and the magnetic toner contains a number-basis percentage Y (%) of particles having Ci≧0.950 within particles of 3 $\mu$m or larger satisfying:

$$Y \geqq X^{-0.645} \times exp\ 5.51 \quad (2).$$

7. The process cartridge according to claim 5, wherein the magnetic toner particles have a BET specific surface area of 0.7–1.3 $m^2/g$.

8. The process cartridge according to claim 5, wherein the magnetic toner has a density of 1.3–2.2 $g/cm^3$.

9. The process cartridge according to claim 5, wherein the process cartridge further includes a cleaning means for surface-cleaning the image-bearing member.

10. The process cartridge according to claim 5, wherein the developing means includes a toner-carrying member for carrying and conveying a layer of the magnetic toner thereon, and the toner-carrying member is disposed with a gap from the image-bearing member so that the magnetic toner layer thickness on the toner-carrying member is smaller than the gap.

* * * * *

UNITED STATES PATENT AND TRADEMARK OFFICE

CERTIFICATE OF CORRECTION

PATENT NO. : 6,630,275 B2
DATED : October 7, 2003
INVENTOR(S) : Kaori Hiratsuka et al.

It is certified that error appears in the above-identified patent and that said Letters Patent is hereby corrected as shown below:

Column 4,
Line 60, “may” should read -- way --.

Column 7,
Line 55, “enjoin” should read -- enjoying --.

Column 10,
Line 37, “a a” should read -- as a --;
Line 40, “provide” should read -- provided --.

Column 14,
Line 9, “rage” should read -- rate --.

Column 17,
Line 32, “propanedi-acrylate,” should read -- propanediacrylate, --.

Column 21,
Line 30, “derivatives” should read -- derivatives. --;
Line 55, “selected from include:” should read -- selected from the group including --.

Column 23,
Line 40, “trimethylsily-mercaptan,” should read -- trimethylsilylmercaptan, --.

Column 27,
Line 10, “commercially” should read -- those commercially --.

Column 28,
Line 20, “member” should read -- members --.

Column 30,
Line 4, “(84 $\mu$m))” should read -- (84 $\mu$m) --;
Line 44, “5tht sheet” should read -- 5$^{th}$ sheet --.

Column 32,
Line 30, “d-1.70 g/cm,” should read -- d=1.70 g/cm$^3$, --.

UNITED STATES PATENT AND TRADEMARK OFFICE

CERTIFICATE OF CORRECTION

PATENT NO. : 6,630,275 B2
DATED : October 7, 2003
INVENTOR(S) : Kaori Hiratsuka et al.

It is certified that error appears in the above-identified patent and that said Letters Patent is hereby corrected as shown below:

Column 38,
Line 29, “articles” should read -- particles --.

Signed and Sealed this

Thirteenth Day of April, 2004

JON W. DUDAS
*Acting Director of the United States Patent and Trademark Office*